US011155768B2

(12) United States Patent
Abe et al.

(10) Patent No.: US 11,155,768 B2
(45) Date of Patent: Oct. 26, 2021

(54) LUBRICANT OIL COMPOSITIONS FOR AUTOMOTIVE GEARS

(71) Applicant: MITSUI CHEMICALS, INC., Tokyo (JP)

(72) Inventors: Shota Abe, Chiba (JP); Terufumi Suzuki, Ichihara (JP)

(73) Assignee: MITSUI CHEMICALS, INC., Tokyo (JP)

( * ) Notice: Subject to any disclaimer, the term of this patent is extended or adjusted under 35 U.S.C. 154(b) by 0 days.

(21) Appl. No.: 16/475,224

(22) PCT Filed: Jan. 5, 2018

(86) PCT No.: PCT/JP2018/000099
§ 371 (c)(1),
(2) Date: Jul. 1, 2019

(87) PCT Pub. No.: WO2018/131543
PCT Pub. Date: Jul. 19, 2018

(65) Prior Publication Data

US 2019/0338212 A1 Nov. 7, 2019

(30) Foreign Application Priority Data

Jan. 16, 2017 (JP) ..... JP2017-005194

(51) Int. Cl.

| | |
|---|---|
| ***C10M 169/04*** | (2006.01) |
| ***C10M 143/04*** | (2006.01) |
| ***C10M 101/02*** | (2006.01) |
| *C10N 20/02* | (2006.01) |
| *C10N 20/04* | (2006.01) |
| *C10N 30/02* | (2006.01) |
| *C10N 40/08* | (2006.01) |
| *C10N 40/04* | (2006.01) |

(52) U.S. Cl.
CPC ..... *C10M 169/041* (2013.01); *C10M 101/02* (2013.01); *C10M 143/04* (2013.01); *C10M 2203/003* (2013.01); *C10M 2203/1006* (2013.01); *C10M 2205/022* (2013.01); *C10M 2205/024* (2013.01); *C10N 2020/02* (2013.01); *C10N 2020/04* (2013.01); *C10N 2030/02* (2013.01); *C10N 2040/044* (2020.05); *C10N 2040/08* (2013.01)

(58) Field of Classification Search
CPC ..... C10M 101/00; C10M 169/041; C10M 143/04; C10M 2205/022; C10N 2030/02
See application file for complete search history.

(56) References Cited

U.S. PATENT DOCUMENTS

| | | | |
|---|---|---|---|
| 3,780,128 | A | 12/1973 | Shnbkin |
| 3,909,432 | A | 9/1975 | McGuire et al. |
| 4,032,591 | A | 6/1977 | Cupples et al. |
| 4,668,834 | A | 5/1987 | Rim et al. |
| 4,704,491 | A | 11/1987 | Tsutsui et al. |
| 4,892,851 | A | 1/1990 | Ewen et al. |
| 4,908,411 | A | 3/1990 | Kinoshita et al. |
| 4,956,512 | A | 9/1990 | Nissfolk et al. |
| 4,960,878 | A | 10/1990 | Crapo et al. |
| 4,990,640 | A | 2/1991 | Tsutsui et al. |
| 5,026,798 | A | 6/1991 | Canich |
| 5,041,584 | A | 8/1991 | Crapo et al. |
| 5,055,438 | A | 10/1991 | Canich |
| 5,057,475 | A | 10/1991 | Canich et al. |
| 5,093,418 | A | 3/1992 | Kinoshita et al. |
| 5,096,867 | A | 3/1992 | Canich |
| 5,153,157 | A | 10/1992 | Hlatky et al. |
| 5,155,080 | A | 10/1992 | Elder et al. |
| 5,158,920 | A | 10/1992 | Razavi |
| 5,162,278 | A | 11/1992 | Razavi |
| 5,195,401 | A | 3/1993 | Mouton |
| 5,223,467 | A | 6/1993 | Razavi |
| 5,223,468 | A | 6/1993 | Razavi |
| 5,225,500 | A | 7/1993 | Elder et al. |

(Continued)

FOREIGN PATENT DOCUMENTS

| | | |
|---|---|---|
| EP | 0 668 342 A1 | 8/1995 |
| EP | 0 776 959 A2 | 6/1997 |

(Continued)

OTHER PUBLICATIONS

US 5,168,111 A, 12/1992, Canich (withdrawn)
Machine Translation of Kamiya (JP-2016069408-A) (Year: 2006).*
Machine Translation of JP-2016069408-A (Year: 2016).*
International Searching Authority, "International Search Report," issued in connection with International Patent Application No. PCT/JP2018/000099, dated Mar. 6, 2018.
International Searching Authority, "Written Opinion," issued in connection with International Patent Application No. PCT/JP2018/000099, dated Mar. 6, 2018.
Office Action dated May 27, 2020 for corresponding Korean Patent Application No. 10-2019-7016857.

(Continued)

*Primary Examiner* — Ellen M McAvoy
*Assistant Examiner* — Ming Cheung Po
(74) *Attorney, Agent, or Firm* — Foley & Lardner LLP

(57) ABSTRACT

A lubricant oil composition for automotive gears includes a lubricant base oil including a mineral oil having a kinematic viscosity at 100° C. of 2.0 to 6.5 $mm^2/s$, a viscosity index of not less than 105 and a pour point of not more than −10° C., and/or a synthetic oil having a kinematic viscosity at 100° C. of 1.0 to 6.5 $mm^2/s$, a viscosity index of not less than 120 and a pour point of not more than −30° C.; and an ethylene/α-olefin copolymer having an ethylene content of 55 to 85 mol %, a kinematic viscosity at 100° C. of 10 to 200 $mm^2/s$, a molecular weight distribution of not more than 2.2, and a melting point in the range of −30° C. to −60° C. The lubricant oil composition for automotive gears has a kinematic viscosity at 100° C. of 4.0 to 9.0 $mm^2/s$.

5 Claims, No Drawings

(56) References Cited

U.S. PATENT DOCUMENTS 5,227,440 A 7/1993 Canich et al.
5,241,025 A 8/1993 Hlatky et al.
5,243,002 A 9/1993 Razavi
5,264,405 A 11/1993 Canich
5,278,119 A 1/1994 Turner et al.
5,278,265 A 1/1994 Razavi
5,292,838 A 3/1994 Razavi
5,304,523 A 4/1994 Razavi
5,321,106 A 6/1994 LaPointe
5,334,677 A 8/1994 Razavi et al.
5,384,299 A 1/1995 Turner et al.
5,387,568 A 2/1995 Ewen et al.
5,391,629 A 2/1995 Turner et al.
5,407,884 A 4/1995 Turner et al.
5,408,017 A 4/1995 Turner et al.
5,420,217 A 5/1995 Canich
5,470,927 A 11/1995 Turner et al.
5,483,014 A 1/1996 Turner et al.
5,504,169 A 4/1996 Canich
5,519,100 A 5/1996 Ewen et al.
5,547,675 A 8/1996 Canich
5,561,092 A 10/1996 Ewen et al.
5,589,556 A 12/1996 Razavi
5,599,761 A 2/1997 Turner
5,614,457 A 3/1997 Ewen et al.
5,621,126 A 4/1997 Canich et al.
5,631,391 A 5/1997 Canich
5,663,249 A 9/1997 Ewen et al.
5,767,331 A 1/1998 Oda et al.
5,723,560 A 3/1998 Canich
5,763,549 A 6/1998 Elder et al.
5,801,113 A 9/1998 Jejelowo et al.
5,807,939 A 9/1998 Elder et al.
5,883,202 A 3/1999 Ewen et al.
5,955,639 A 9/1999 Oda et al.
6,008,164 A 12/1999 Aldrich et al.
6,059,955 A 5/2000 Cody et al.
6,080,301 A 6/2000 Berlowitz et al.
6,090,989 A 7/2000 Trewella et al.
6,096,940 A 8/2000 Wittenbrink et al.
6,103,099 A 8/2000 Wittenbrink et al.
6,121,395 A 9/2000 Turner
6,153,807 A 11/2000 Oda et al.
6,165,949 A 12/2000 Berlowitz et al.
6,232,420 B1 5/2001 Turner
6,245,706 B1 6/2001 Hlatky
6,265,338 B1 7/2001 Canich
6,294,625 B1 9/2001 Hlatky et al.
6,332,974 B1 12/2001 Wittenbrink et al.
6,355,592 B1 3/2002 Hlatky et al.
6,417,120 B1 7/2002 Mitchler et al.
6,420,618 B1 7/2002 Berlowitz et al.
6,423,795 B1 7/2002 Canich et al.
6,459,005 B1 10/2002 Hirano et al.
6,475,960 B1 11/2002 Berlowitz et al.
6,506,297 B1 1/2003 Wittenbrink et al.
6,589,920 B2 * 7/2003 Okada ..... C10M 143/02 508/591
6,599,864 B1 7/2003 Bertomeu
6,617,466 B1 9/2003 Canich
6,632,898 B1 10/2003 Canich
6,858,767 B1 2/2005 DiMaio et al.
7,041,841 B1 5/2006 Canich
7,163,907 B1 1/2007 Canich et al.
7,569,646 B1 8/2009 Canich
8,410,035 B2 4/2013 Kaneshige et al.
8,606,355 B1 12/2013 Krause
10,077,412 B2 * 9/2018 Yamamoto ..... C10M 143/06
2002/0010290 A1 1/2002 Minami et al.
2002/0086803 A1 7/2002 Berlowitz et al.
2002/0143113 A1 10/2002 Minami et al.
2002/0155776 A1 10/2002 Mitchler et al.
2006/0025316 A1 2/2006 Covitch et al.
2006/0178491 A1 8/2006 Canich
2007/0043248 A1 2/2007 Wu et al.
2008/0177121 A1 7/2008 Wu et al.
2009/0005279 A1 1/2009 Wu et al.
2009/0023619 A1 1/2009 Kaneshige et al.
2009/0312211 A1 12/2009 Yamada et al.
2010/0273692 A1 * 10/2010 Kolb ..... C08L 23/16 508/591
2010/0273693 A1 10/2010 Datta et al.
2010/0273936 A1 10/2010 Yeh et al.
2010/0292424 A1 11/2010 Wu et al.
2010/0311624 A1 12/2010 Covitch et al.
2011/0183878 A1 * 7/2011 Kolb ..... C08F 210/02 508/591
2011/0183879 A1 7/2011 Kolb et al.
2012/0028865 A1 2/2012 Datta et al.
2012/0028866 A1 2/2012 Datta et al.
2012/0028867 A1 2/2012 Datta et al.
2013/0085092 A1 4/2013 Kolb et al.
2013/0131256 A1 5/2013 Datta et al.
2013/0158307 A1 6/2013 Wu et al.
2013/0203640 A1 8/2013 Matsunaga et al.
2013/0203641 A1 8/2013 Kolb et al.
2013/0245343 A1 9/2013 Emett et al.
2013/0281339 A1 10/2013 Kolb et al.
2013/0281340 A1 10/2013 Kolb
2014/0080982 A1 3/2014 Kolb et al.
2014/0378720 A1 12/2014 Wu et al.
2015/0031831 A1 1/2015 Ravishankar
2015/0252279 A1 9/2015 Wu
2016/0347893 A1 12/2016 Kolb et al.
2017/0253827 A1 9/2017 Abe et al.

FOREIGN PATENT DOCUMENTS

EP 1 887 075 A1 2/2008
EP 1 029 029 B1 6/2013
EP 3 122 790 A1 2/2017
JP S57-117595 A 7/1982
JP S61-126120 A 6/1986
JP S61-221207 A 10/1986
JP H01-163136 A 6/1989
JP H01-501950 A 7/1989
JP H01-502036 A 7/1989
JP H02-1163 B2 1/1990
JP H02-24701 A 1/1990
JP H02-7998 B2 2/1990
JP H02-78687 A 3/1990
JP H02-167305 A 6/1990
JP H03-103407 A 4/1991
JP H03-131612 A 6/1991
JP H03-179005 A 8/1991
JP H03-179006 A 8/1991
JP H03-207703 A 9/1991
JP H03-207704 A 9/1991
JP H05-59119 A 3/1993
JP H07-121696 B2 12/1995
JP 2593264 B2 3/1997
JP 2796376 B2 9/1998
JP 2000-351813 A 12/2000
JP 2001-335607 A 12/2001
JP 2004-051676 A 2/2004
JP 2004-506758 A 3/2004
JP 2008-037963 A 2/2008
JP 2008-508402 A 3/2008
JP 2009-503147 A 1/2009
JP 2009-514991 A 4/2009
JP 2009-155561 A 7/2009
JP 2012-525470 A 10/2012
JP 2016-069404 A 5/2016
JP 2016-069405 A 5/2016
JP 2016-069406 A 5/2016
JP 2016069408 A * 5/2016
WO WO-97/21788 A1 6/1997
WO WO-99/41332 A1 8/1999
WO WO-00/08115 A1 2/2000
WO WO-00/14179 A1 3/2000
WO WO-00/14183 A1 3/2000
WO WO-00/14187 A2 3/2000
WO WO-00/14188 A2 3/2000
WO WO-00/15736 A2 3/2000

(56) References Cited

FOREIGN PATENT DOCUMENTS

| | | | | |
|---|---|---|---|---|
| WO | WO-01/18156 | A1 | 3/2001 | |
| WO | WO-01/57166 | A1 | 8/2001 | |
| WO | WO-2006102153 | A1 * | 9/2006 | ..... C08L 23/10 |
| WO | WO-2015/148889 | A1 | 10/2015 | |
| WO | WO-2016/039295 | A1 | 3/2016 | |

OTHER PUBLICATIONS

Notice of Allowance dated Oct. 27, 2020 for corresponding Korean Patent Application No. 10-2019-7016857.

Extended European Search Report dated Sep. 9, 2020 for corresponding European Patent Application No. 18738879.8.

Neste Oil: "Based oil Brochure 2013", Jan. 24, 2014 (Jan. 24, 2014), XP055725564, Retrieved from the Internet: URL: https://www.oil-club.ru/forum/applications/core/interface/file/attachment.php?id=23945.

* cited by examiner

LUBRICANT OIL COMPOSITIONS FOR AUTOMOTIVE GEARS

RELATED APPLICATIONS

The present application claims priority under 37 U.S.C. § 371 to International Patent Application No. PCT/JP2018/000099, filed Jan. 5, 2018, which claims priority to and the benefit of Japanese Patent Application No. 2017-005194, filed on Jan. 16, 2017. The contents of these applications are hereby incorporated by reference in their entireties.

TECHNICAL FIELD

The present invention relates to lubricant oil compositions for automotive gears.

BACKGROUND ART

Lubricant oils such as gear oils, transmission oils, hydraulic oils and greases are required to protect and release heat from internal combustion engines and machine tools, and are also required to meet various properties such as wear resistance, heat resistance, sludge resistance, lubricant consumption characteristics and fuel efficiency. As internal combustion engines and industrial machines which are lubricated have grown in performance and output and have come to be operated under severer conditions in recent years, the lubricant performance that is required is more and more advanced. Recently, in particular, an extension in lubricant life tends to be demanded out of environmental considerations despite the fact that the conditions under which lubricants are used are becoming harsher. This tendency has given rise to a demand for enhancements in heat resistance and oxidation stability, and has further created a demand that the decrease in viscosity due to shear stress caused by internal combustion engines and machine tools be reduced, that is, lubricants exhibit enhanced shear stability. On the other hand, in order to enhance the energy conversion efficiency of internal combustion engines or to ensure good lubrication of internal combustion engines in an extremely cold environment, importance is placed on temperature viscosity characteristics in which lubricants keep the form of an oil film at high temperatures while still attaining good retention of fluidity at low temperatures. One of the indicators to quantify the temperature viscosity characteristics discussed here is a viscosity index calculated by the method described in JIS K2283. The higher the viscosity index of a lubricant, the superior the temperature viscosity characteristics.

As described above, there has been a demand for lubricants having excellent heat resistance, oxidation stability and shear stability and also having good temperature viscosity characteristics.

In particular, lubricants used in automobiles have come to be required to outperform the conventional lubricants in temperature viscosity characteristics. The temperature viscosity characteristics, which directly affect the fuel efficiency performance of automobiles, are required to be enhanced because after the adoption of the Kyoto Protocol in 1997, governments in the world have recently worked on or have set future targets on controlling carbon dioxide emissions from vehicles and regulating the fuel efficiency.

Based on the governmental decisions, automotive machine parts are more and more compact and receive less lubricants in order to enhance the fuel efficiency so that the fuel efficiency targets will be accomplished. This situation increases the load on lubricants and has given rise to a need for a further increase in lubricant life. Further, in recent years, some of automotive transmission oils particularly for ordinary automobiles have been come to be required to be used without necessity of replacement, and therefore it is urgently needed to further increase the lubricant life.

Since automotive gear oils are subjected to shear stress that is applied by gears, bearings or the like, molecules used in the lubricant base are broken during use. Consequently, lubricant viscosity reduces. The decrease in lubricant viscosity causes metallic parts in gears to be in contact together, resulting in significant damages to the machines. It is therefore necessary to design the initial viscosity of a lubricant as produced to be high beforehand in expectation of a viscosity drop during use so that the lubricant after being degraded by use can provide ideal lubrication. SAE (the Society of Automobile Engineers) J306 (automotive gear oil viscosity classification) is shown in Table 1. This viscosity classification defines the minimum viscosities after the shear test specified by CRC L-45-T-93.

TABLE 1

| Viscosity grade *1 | Maximum temperature of giving viscosity 150,000 mPa · s *2 | Kinematic viscosity at 100° C. *3 Minimum | Kinematic viscosity at 100° C. *3 Maximum | Minimum kinematic viscosity at 100° C. after shear test *4 |
|---|---|---|---|---|
| 75 W | −40° C. | 4.1 | Not | 4.1 |
| 80 W | −26° C. | 7.0 | specified | 7.0 |
| 80 | Not specified | 7.0 | 11.0 | 7.0 |
| 85 | | 11.0 | 13.5 | 11.0 |
| 90 | | 13.5 | 18.5 | 13.5 |
| 110 | | 18.5 | 24.0 | 18.5 |
| 140 | | 24.0 | 32.5 | 24.0 |

*1 Gear oils meeting two viscosity grades in the table are defined as multi-grade gear oils, and denoted by symbols of both the viscosity grades. For example, gear oils meeting grades 75W and 90 in the table are expressed as 75W-90.
*2 Measured according to ASTM D2983.
*3 Measured according to ASTM D445.
*4 The shear test is conducted according to CRC L-45-T-93, and the kinematic viscosity at 100° C. is measured after the test.

As a matter of fact, when the base used in the lubricant has high shear stability, i.e. the life of the lubricant increases, the lubricant does not need to be designed with a high initial viscosity and consequently the resistance experienced by gears during stirring of the lubricant can be reduced, which results in an enhancement in fuel efficiency.

Based on this concept, the risk of contact between metallic parts in gears is increasingly high as a result of a recent approach to enhancing fuel efficiency by the reduction of the stirring resistance of lubricants by using so-called low-viscosity lubricants which are differential gear oils or manual transmission oils having a viscosity lower than the conventional level. Thus, materials that are extremely stable to shear and do not decrease viscosity are desired.

Based on this reduction of viscosity of lubricants, with respect to the J306 classification of minimum viscosities after 20 hours of the CRC L-45-T-93 shear test, it has been gradually required to meet a new classification that defines minimum viscosities to be possessed by drive oils after the same test for 5 times as long as usual, namely, 100 hours.

Further, good temperature viscosity characteristics, in other words, low dependence of lubricant viscosity on temperature makes an increase in lubricant viscosity small in a cold environment at the time of starting of internal combustion engines. Consequently, the increase in gear resistance due to the lubricant is relatively small as compared to lubricants having high dependence of viscosity on temperature, and thus the fuel efficiency can be enhanced.

Therefore, lubricants having higher viscosity index has higher fuel efficiency.

Viscosity modifiers having excellent shear strength, such as liquid polybutene and bright stocks, have been heretofore used for differential gear oils and manual transmission oils, but these viscosity modifiers have been required to be improved in terms of temperature viscosity characteristics, i.e. the viscosity index, in the recent increasing demand for high fuel efficiency.

Poly-α-olefins (PAOs) are used as synthetic lubricant bases for satisfying the above requirement. As described in, among others, Patent Documents 1 to 3, PAOs may be obtained by the oligomerization of higher α-olefins using acid catalysts.

As described in Patent Document 4, ethylene/α-olefin copolymers, similarly to PAOs, are known to be employable as synthetic lubricants having excellent viscosity index, oxidation stability, shear stability and heat resistance.

Conventional methods for the production of ethylene/α-olefin copolymers used as synthetic lubricants involve vanadium catalysts including a vanadium compound and an organoaluminum compound as described in Patent Document 5 and Patent Document 6. The mainstream of ethylene/α-olefin copolymers produced by such methods is ethylene/propylene copolymers.

Methods using catalyst systems including a metallocene compound such as zirconocene and an organoaluminum oxy compound (aluminoxane) such as, among others, those described in Patent Document 7 and Patent Document 8 are known to produce copolymers with high polymerization activity. Patent Document 9 discloses a method for producing a synthetic lubricant including an ethylene/α-olefin copolymer produced by using a combination of a specific metallocene catalyst and an aluminoxane as a catalyst system.

In recent years, there has been an increasing trend in the demand for PAOs, ethylene/propylene copolymers or the like, which are synthetic lubricant bases having excellent low-temperature viscosity characteristics and shear stability. From the points of view of higher fuel efficiency, there is room for improvement in viscosity index.

To meet such demands, PAOs have been invented which are obtained by, among others, methods described in Patent Documents 10 to 13 using a catalyst system including a metallocene compound such as zirconocene and an organoaluminum oxy compound (aluminoxane).

However, while the temperature viscosity characteristics of PAOs obtained using a metallocene catalyst are enhanced with an increase in molecular weight when the PAOs are used for lubricants, there is a trade-off in that shear stability is decreased. In this regard, shear stability and temperature viscosity characteristics are not sufficiently satisfied at the same time.

Patent Documents 14 and 15 suggest lubricant oil compositions containing a specific ethylene/α-olefin copolymer.

CITATION LIST

Patent Literature

Patent Document 1: U.S. Pat. No. 3,780,128
Patent Document 2: U.S. Pat. No. 4,032,591
Patent Document 3: JP-A-H01-163136
Patent Document 4: JP-A-S57-117595
Patent Document 5: JP-B-H02-1163
Patent Document 6: JP-B-H02-7998
Patent Document 7: JP-A-S61-221207
Patent Document 8: JP-B-H07-121969
Patent Document 9: Japanese Patent No. 2796376
Patent Document 10: JP-A-2001-335607
Patent Document 11: JP-A-2004-506758
Patent Document 12: JP-A-2009-503147
Patent Document 13: JP-A-2009-514991
Patent Document 14: JP-A-2016-69404
Patent Document 15: JP-A-2016-69405

SUMMARY OF INVENTION

Technical Problem

An object of the present invention is to provide lubricant oil compositions for automotive gears which have extremely excellent shear stability and which have an excellent ability to keep the form of an oil film and excellent temperature viscosity characteristics at a high level and with a good balance.

Solution to Problem

The present inventors carried out extensive studies directed to developing lubricant oil compositions having extremely excellent performance. As a result, the present inventors have found that lubricant oil compositions including a specific lubricant base oil and a specific ethylene/α-olefin copolymer and satisfying specific requirements can solve the problems discussed above, thus completing the present invention. Specifically, some aspects of the invention reside in the following.

[1] A lubricant oil composition for automotive gears, including a lubricant base oil including a mineral oil (A) having characteristics (A1) to (A3) described below, and/or a synthetic oil (B) having characteristics (B1) to (B3) described below; and an ethylene/α-olefin copolymer (C) having characteristics (C1) to (C5) described below, the lubricant oil composition having a kinematic viscosity at 100° C. of 4.0 to 9.0 $mm^2/s$, (A1) the kinematic viscosity at 100° C. is 2.0 to 6.5 $mm^2/s$, (A2) the viscosity index is not less than 105, (A3) the pour point is not more than −10° C., (B1) the kinematic viscosity at 100° C. is 1.0 to 6.5 $mm^2/s$, (B2) the viscosity index is not less than 120, (B3) the pour point is not more than −30° C., (C1) the ethylene content is in the range of 55 to 85 mol %, (C2) the kinematic viscosity at 100° C. is 10 to 200 $mm^2/s$, (C3) the molecular weight distribution (Mw/Mn) for the molecular weight measured by gel permeation chromatography (GPC) with reference to polystyrene is not more than 2.2, (C4) the pour point is not more than −10° C., (C5) the melting point has a peak in the range of −30° C. to −60° C. and gives a heat of fusion (ΔH) of not more than 25 J/g as measured by differential scanning calorimetry (DSC).

[2] The lubricant oil composition for automotive gears described in [1], wherein the kinematic viscosity of the ethylene-α-olefin copolymer (C) at 100° C. is 20 to 170 $mm^2/s$.

[3] The lubricant oil composition for automotive gears described in [1] or [2], wherein the kinematic viscosity of the ethylene-α-olefin copolymer (C) at 100° C. is 30 to 60 $mm^2/s$.

[4] The lubricant oil composition for automotive gears described in [1], wherein the content of ethylene in the ethylene/α-olefin copolymer (C) is in the range of 58 to 70 mol %.

[5] The lubricant oil composition for automotive gears described in any of [1] to [4], wherein the α-olefin in the ethylene/α-olefin copolymer (C) is propylene.

Effects of Invention

The lubricant oil compositions of the present invention have excellent shear stability, temperature viscosity characteristics and low-temperature viscosity characteristics at a high level and with a good balance compared to conventional lubricants including the same lubricant base oil, and may be suitably used for automotive gears. The lubricant oil compositions of the present invention are suitable as automotive differential gear oils, automotive manual transmission oils, automotive dual clutch transmission oils and the like.

DESCRIPTION OF EMBODIMENTS

Hereinbelow, lubricant oil compositions for automotive gears according to the present invention (hereinafter, also referred to simply as "lubricant oil compositions") will be described in detail.

The lubricant oil compositions for automotive gears according to the present invention include a lubricant base oil and an ethylene/α-olefin copolymer (C), and have a kinematic viscosity at 100° C. of 4.0 to 9.0 $mm^2/s$, the lubricant base oil including a mineral oil (A) and/or a synthetic oil (B).

<Lubricant Base Oils>

The lubricant base oils for use in the present invention have different viscosity characteristics and properties/qualities such as heat resistance and oxidation stability depending on, for example, how they are produced or how they are purified. API (American Petroleum Institute) classifies lubricant base oils into five types: groups I, II, III, IV and V. These API categories, which are defined in API Publication 1509, 15th Edition, Appendix E, April 2002, are shown in Table 2.

TABLE 2

| Group | Type | Viscosity index *1 | Saturated hydrocarbon content *2 (vol %) | Sulfur content *3 (wt %) |
|---|---|---|---|---|
| I | Mineral oil | 80-120 | <90 | >0.03 |
| II | Mineral oil | 80-120 | ≥90 | ≤0.03 |
| III | Mineral oil | ≥120 | ≥90 | ≤0.03 |
| IV | | Poly-α-olefin | | |
| V | | Other lubricant base oils | | |

*1 Measured according to ASTM D445 (JIS K2283).

*2 Measured according to ASTM D3238.

*3 Measured according to ASTM D4294 (JIS K2541).

*4 Group I also includes mineral oils having a saturated hydrocarbon content of less than 90 vol % and a sulfur content of less than 0.03 wt % or having a saturated hydrocarbon content of not less than 90 vol % and a sulfur content of more than 0.03 wt %.

<Mineral Oil (A)>

The mineral oil (A) has characteristics (A1) to (A3) described below.

(A1) The kinematic viscosity at 100° C. is 2.0 to 6.5 $mm^2/s$.

The kinematic viscosity is a value measured in accordance with the method described in JIS K2283. The kinematic viscosity at 100° C. of the mineral oil (A) is 2.0 to 6.5 $mm^2/s$, preferably 2.5 to 5.8 $mm^2/s$, and more preferably 2.8 to 4.5 $mm^2/s$. This range of the kinematic viscosity at 100° C. ensures that the lubricant oil compositions of the present invention are excellent in volatility and temperature viscosity characteristics.

(A2) The viscosity index is not less than 105.

The viscosity index is a value measured in accordance with the method described in JIS K2283. The viscosity index of the mineral oil (A) is not less than 105, preferably not less than 115, and more preferably not less than 120. This range of the viscosity index ensures that the lubricant oil compositions of the present invention have excellent temperature viscosity characteristics.

(A3) The pour point is not more than −10° C.

The pour point is a value measured in accordance with the method described in ASTM D97. The pour point of the mineral oil (A) is not more than −10° C., and preferably not more than −15° C. This range of the pour point ensures that the lubricant oil compositions of the present invention have excellent low-temperature viscosity characteristics when the mineral oil (A) is used in combination with a pour-point depressant.

The mineral oil (A) in the present invention belongs to groups I to III among the API categories described above.

The mineral oils have qualities as described above, and the mineral oils of the respective qualities described above are obtained depending on how they are purified. A specific example of the mineral oil (A) is mineral oils obtained by a process in which atmospheric residue obtained by the atmospheric distillation of crude oil is vacuum distilled and the resultant lubricant fraction is purified by one or more treatments such as solvent deasphalting, solvent extraction, hydrocracking, solvent dewaxing and hydrogenation purification. Another example of the mineral oil (A) is lubricant base oils such as wax isomerized mineral oils.

Further, gas-to-liquid (GTL) base oils obtained by the Fischer-Tropsch process are another lubricant base oils which may be suitably used as mineral oils of group III. These GTL base oils, which may be treated as group III+lubricant base oils, are described in patent documents such as EP 0776959, EP 0668342, WO 97/21788, WO 00/15736, WO 00/14188, WO 00/14187, WO 00/14183, WO 00/14179, WO 00/08115, WO 99/41332, EP 1029029, WO 01/18156 and WO 01/57166.

In the lubricant oil compositions of the present invention, the mineral oil (A) may be used alone, or any mixture of two or more lubricants selected from synthetic oils (B) and mineral oils (A), among others, may be used as a lubricant base oil.

<Synthetic Oil (B)>

The synthetic oil (B) has characteristics (B1) to (B3) described below.

(B1) The kinematic viscosity at 100° C. is 1.0 to 6.5 $mm^2/s$.

The kinematic viscosity is a value measured in accordance with the method described in JIS K2283. The kinematic viscosity at 100° C. of the synthetic oil (B) is 1.0 to 6.5 $mm^2/s$, preferably 1.5 to 4.5 $mm^2/s$, and more preferably 1.8 to 4.3 $mm^2/s$. This range of the kinematic viscosity at 100° C. ensures that the lubricant oil compositions of the present invention have excellent in volatility and temperature viscosity characteristics.

(B2) The viscosity index is not less than 120.

The viscosity index is a value measured in accordance with the method described in JIS K2283. The viscosity index of the synthetic oil (B) is not less than 120, and preferably not less than 125. This range of the viscosity index ensures that the lubricant oil compositions of the present invention have excellent temperature viscosity characteristics.

(B3) The pour point is not more than −30° C.

The pour point is a value measured in accordance with the method described in ASTM D97. The pour point of the synthetic oil (B) is not more than −30° C., preferably not more than −40° C., more preferably not more than −50° C., and still more preferably not more than −60° C. This range of the pour point ensures that the lubricant oil compositions of the present invention have excellent low-temperature viscosity characteristics.

The synthetic oil (B) in the present invention belongs to group IV or group V among the API categories described above.

Poly-α-olefins belonging to group IV can be obtained by oligomerization of a higher α-olefin with an acid catalyst as described in U.S. Pat. Nos. 3,780,128 and 4,032,591 and JP-A-H01-163136. As the poly-α-olefins, low-molecular-weight oligomers of at least one olefin selected from olefins having 8 or more carbon atoms can be used. The use of a poly-α-olefin as the lubricant base oil ensures that lubricant oil compositions having extremely excellent temperature viscosity characteristics and low-temperature viscosity characteristics, and excellent heat resistance are obtained.

The poly-α-olefins may be purchased in industry, and those having a kinematic viscosity at 100° C. of 2 $mm^2/s$ to 10 $mm^2/s$ are commercially available. Examples include NEXBASE 2000 Series manufactured by NESTE, Spectrasyn manufactured by Exxon Mobil Chemical, Durasyn manufactured by Ineos Oligomers, and Synfluid manufactured by Chevron Phillips Chemical.

Examples of the synthetic oils belonging to group V include alkyl benzenes, alkyl naphthalenes, isobutene oligomers or hydrides thereof, paraffins, polyoxyalkylene glycols, dialkyl diphenyl ethers, polyphenyl ethers and esters.

The alkylbenzenes and the alkylnaphthalenes are most often dialkylbenzenes or dialkylnaphthalenes usually having alkyl chains composed of 6 to 14 carbon atoms. Such alkylbenzenes and alkylnaphthalenes are produced by the Friedel-Crafts alkylation of benzene or naphthalene with olefins. The alkyl olefins used in the production of the alkylbenzenes or the alkylnaphthalenes may be linear or branched olefins or combinations of such olefins. For example, a method for producing such compounds is described in U.S. Pat. No. 3,909,432.

Further, from the point of view of compatibility with the ethylene-α-olefin copolymer (C) described later, the ester is preferably a fatty acid ester.

Examples of the fatty acid esters, although not particularly limited to, include the following fatty acid esters composed solely of carbon, oxygen and hydrogen. Examples include monoesters produced from monobasic acids and alcohols; diesters produced from dibasic acids and alcohols, or from diols and monobasic acids or acid mixtures; and polyol esters produced by reacting monobasic acids or acid mixtures with diols, triols (for example, trimethylolpropane), tetraols (for example, pentaerythritol) hexaols (for example, dipentaerythritol) or the like. Examples of such esters include ditridecyl glutarate, di-2-ethylhexyl adipate, diisodecyl adipate, ditridecyl adipate, di-2-ethylhexyl sebacate, tridecyl pelargonate, di-2-ethylhexyl adipate, di-2-ethylhexyl azelate, trimethylolpropane caprylate, trimethylolpropane pelargonate, trimethylolpropane triheptanoate, pentaerythritol-2-ethylhexanoate, pentaerythritol pelargonate, and pentaerythritol tetraheptanoate.

Further, from the viewpoint of compatibility with the ethylene/α-olefin copolymer (C), the alcohol moiety constituting the ester is preferably an alcohol having two or more hydroxyl groups, and the fatty acid moiety is preferably a fatty acid having 8 or more carbon atoms. In view of production costs, the fatty acid is advantageously one having 20 or less carbon atoms which can be easily obtained in industry. The effect of the present invention is sufficiently exhibited regardless of whether the fatty acid constituting the ester is a single acid, or a fatty acid ester produced using a mixture of two or more acids is used. Specific examples of the fatty acid esters include trimethylolpropane laurate/stearate triester and diisodecyl adipate, which are preferable in terms of the compatibility with saturated hydrocarbon components such as the ethylene/α-olefin copolymer (C) and with stabilizers having a polar group described later such as antioxidants, corrosion inhibitors, antiwear agents, friction modifiers, pour-point depressants, antirust agents and antifoaming agents.

It is preferable that the lubricant oil composition of the present invention contain an ester and a synthetic oil other than an ester as the synthetic oil (B) which is a lubricant base oil, and when the synthetic oil (B), in particular, a poly-α-olefin is used as the lubricant base oil, it is preferable that the lubricant oil composition contain a fatty acid ester in an amount of 5 to 20 mass % with respect to the whole lubricant oil composition taken as 100 mass %. The incorporation of 5 mass % or more of a fatty acid ester provides good compatibility with lubricant sealants such as resins and elastomers in various internal combustion engines and inner portion of industrial machines. Specifically, the swelling of lubricant sealants can be prevented. From the point of view of oxidation stability or heat resistance, the amount of the ester is preferably not more than 20 mass %. When the lubricant oil composition contains a mineral oil, the fatty acid ester is not always necessary because the mineral oil itself serves to prevent the swelling of lubricant sealants.

<Ethylene-α-Olefin Copolymer (C)>

The ethylene/α-olefin copolymer (C) according to the present invention has characteristics (C1) to (C5) described below.

(C1) The ethylene content is 55 to 85 mol %.

The content of ethylene in the ethylene/α-olefin copolymers (C) is 55 to 85 mol %, preferably 58 to 70 mol %, and particularly preferably 60 to 68 mol %. If the ethylene content is excessively lower than the above range, the viscosity temperature characteristics of the lubricant oil compositions may be deteriorated. If the ethylene content is excessively higher than the above range, the extension of ethylene chains in the molecules may give rise to crystallinity, resulting in deteriorations in low-temperature viscosity characteristics of the lubricant oil compositions.

The content of ethylene in the ethylene/α-olefin copolymer (C) is measured by $^{13}C$-NMR in accordance with the method described in "Koubunshi Bunseki Handbook (Polymer Analysis Handbook)" (published from Asakura Publishing Co., Ltd., pp. 163-170). Alternatively, the ethylene content may be determined by Fourier transform infrared spectroscopy (FT-IR) using samples with a known ethylene content prepared by the above method.

(C2) The kinematic viscosity at 100° C. is 10 to 200 $mm^2/s$.

The kinematic viscosity is a value measured in accordance with the method described in JIS K2283. The kinematic viscosity at 100° C. of the ethylene/α-olefin copolymer (C) is in the range of 10 to 200 $mm^2/s$, preferably 20 to 170 $mm^2/s$, more preferably 30 to 100 $mm^2/s$, still more preferably 30 to 65 $mm^2/s$, and most preferably 30 to 60 $mm^2/s$. This range of the kinematic viscosity at 100° C. of the ethylene/α-olefin copolymer (C) is preferable in terms of the shear stability and the low-temperature viscosity characteristics of the lubricant oil composition.

Further, the intrinsic viscosity of the ethylene/α-olefin copolymer (C) is preferably less than 0.2 dl/g.

(C3) The molecular distribution is not more than 2.2

The molecular weight distribution of the ethylene/α-olefin copolymer (C) is calculated as a ratio of a weight average molecular weight (Mw) to a number average molecular weight (Mn) (Mw/Mn). The weight average molecular weight (Mw) and the number average molecular weight (Mn) are measured in accordance with the method described later by gel permeation chromatography (GPC) with reference to polystyrene standards. The ratio (Mw/Mn) is not more than 2.2, preferably not more than 2.0, and more preferably not more than 1.8. If the molecular weight distribution is excessively higher than this range, lubricant oil compositions undergo a viscosity change due to volatilization of low-molecular-weight components when used in a high-temperature environment, or the shear stability of the lubricant oil compositions is deteriorated. Further, the molecular weight distribution of the ethylene/α-olefin copolymer (C) is preferably not less than 1.4. This range of the molecular weight distribution ensures that the lubricant oil compositions have excellent viscosity temperature characteristics.

(C4) The pour point is not more than −10° C.

The pour point is a value measured in accordance with the method described in ASTM D97. The pour point of the ethylene/α-olefin copolymer (C) is not more than −10° C., preferably not more than −15° C., more preferably not more than −20° C., and still more preferably not more than −25° C. This range of the pour point ensures that the lubricant oil compositions of the present invention have excellent low-temperature viscosity characteristics.

(C5) The melting point has a peak in the range of −30° C. to −60° C. and gives a heat of fusion (ΔH) of not more than 25 J/g as measured by differential scanning calorimetry (DSC).

In measurement with a differential scanning calorimeter (DSC), the ethylene/α-olefin copolymer (C) is heated to 150° C., then cooled to −100° C., and then heated to 150° C. at a temperature rising rate of 10° C./min, and the DSC curve thus obtained is analyzed with reference to JIS K7121 to determine the melting point (Tm) and the heat of fusion (ΔH) of the ethylene/α-olefin copolymer (C). Under the conditions of differential scanning calorimetry (DSC), the ethylene/α-olefin copolymer (C) shows a peak of a melting point in the range of −30° C. to −60° C., preferably in the range of −35° C. to −58° C., and more preferably in the range of −40° C. to −50° C. The heat of fusion (ΔH) (unit: J/g) measured from the peak of the melting point (Tm) observed here is not more than 25 J/g, preferably not more than 23 J/g, and more preferably not more than 20 J/g. The above ranges of the peak of the melting point and the heat of fusion provide lubricant oil compositions which have excellent low-temperature viscosity characteristics without being solidified in the temperature range of not less than −40° C., and have excellent temperature viscosity characteristics due to intramolecular and/or intermolecular interaction of the ethylene/α-olefin copolymer (C).

Examples of the α-olefins used in the ethylene-α-olefin copolymer (C) include linear or branched α-olefins having 3 to 20 carbon atoms such as propylene, 1-butene, 1-pentene, 3-methyl-1-butene, 1-hexene, 4-methyl-1-pentene, 3-methyl-1-pentene, 1-octene, 1-decene, 1-dodecene, 1-tetradecene, 1-hexadecene, 1-octadecene, 1-eicosene and vinylcyclohexane. Preferred α-olefins are linear or branched α-olefins having 3 to 10 carbon atoms. Propylene, 1-butene, 1-hexene and 1-octene are more preferable. Propylene is most preferable in terms of the shear stability of lubricant oil compositions including the obtainable copolymer. The α-olefins may be used singly, or two or more may be used in combination.

The polymerization may be performed in the presence of at least one other monomer selected from polar group-containing monomers, aromatic vinyl compounds and cycloolefins in the reaction system. Such other monomers may be used in an amount of, for example, not more than 20 parts by mass, and preferably not more than 10 parts by mass with respect to 100 parts by mass of the total of ethylene and the α-olefin(s) having 3 to 20 carbon atoms.

Examples of the polar group-containing monomers include α,β-unsaturated carboxylic acids such as acrylic acid, methacrylic acid, fumaric acid and maleic anhydride; metal salts of these acids such as sodium salts; α,β-unsaturated carboxylate esters such as methyl acrylate, ethyl acrylate, n-propyl acrylate, methyl methacrylate and ethyl methacrylate; vinyl esters such as vinyl acetate and vinyl propionate; and unsaturated glycidyls such as glycidyl acrylate and glycidyl methacrylate.

Examples of the aromatic vinyl compounds include styrene, o-methylstyrene, m-methylstyrene, p-methylstyrene, o,p-dimethylstyrene, methoxystyrene, vinylbenzoic acid, methyl vinylbenzoate, vinylbenzyl acetate, hydroxystyrene, p-chlorostyrene, divinylbenzene, α-methylstyrene and allylbenzene.

Examples of the cycloolefins include those cycloolefins having 3 to 30, preferably 3 to 20 carbon atoms such as cyclopentene, cycloheptene, norbornene, 5-methyl-2-norbornene and tetracyclododecene.

The ethylene/α-olefin copolymer (C) according to the present invention may be produced by any methods without limitation. As described in JP-B-H02-1163 and JP-B-H02-7998, the production may be catalyzed by a vanadium catalyst including a vanadium compound and an organoaluminum compound. To produce the copolymer with high polymerization activity, as described in JP-A-S61-221207, JP-B-H07-121969 and Japanese Patent No. 2796376, use may be made of methods using a catalyst system including a metallocene compound such as zirconocene and an organoaluminum oxy compound (aluminoxane), and from the point of view of the appearance of the copolymer obtained, the use of a metallocene catalyst is more preferable. As compared to the method using a metallocene catalyst, the method using a vanadium catalyst gives rise to a clouded copolymer with an increase in ethylene content, and thus may impair the transparence of lubricant oil compositions produced.

The ethylene/α-olefin copolymer (C) according to the present invention may be produced by copolymerizing ethylene with an α-olefin having 3 to 20 carbon atoms in the presence of an olefin polymerization catalyst including a bridged metallocene compound (a) represented by the general formula [I] below, and at least one compound (b)

selected from the group consisting of organometallic compounds (b-1), organoaluminum oxy compounds (b-2) and compounds (b-3) capable of reacting with the bridged metallocene compound (a) to form an ion pair.

[Chem. 1]

[I]

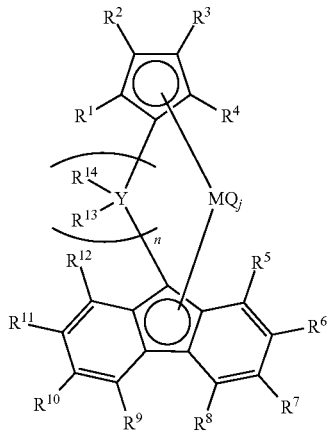

<Bridged Metallocene Compounds>

The bridged metallocene compound (a) is represented by the formula [I] above. Y, M, $R^1$ to $R^{14}$, Q, n and j in the formula [I] will be described below.

(Y, M, $R^1$ to $R^{14}$, Q, n and j)

Y is a Group 14 element, with examples including carbon atom, silicon atom, germanium atom and tin atom, and is preferably a carbon atom or a silicon atom, and more preferably a carbon atom.

M is a titanium atom, a zirconium atom or a hafnium atom, and preferably a zirconium atom.

$R^1$ to $R^{12}$ are each an atom or a substituent selected from the group consisting of a hydrogen atom, a hydrocarbon group having 1 to 20 carbon atoms, a silicon-containing group, a nitrogen-containing group, an oxygen-containing group, a halogen atom and a halogen-containing group, and may be the same as or different from one another. Any adjacent substituents among $R^1$ to $R^{12}$ may be bonded together to form a ring or may not be bonded together.

Examples of the hydrocarbon groups having 1 to 20 carbon atoms include alkyl groups having 1 to 20 carbon atoms, cyclic saturated hydrocarbon groups having 3 to 20 carbon atoms, chain unsaturated hydrocarbon groups having 2 to 20 carbon atoms, cyclic unsaturated hydrocarbon groups having 3 to 20 carbon atoms, alkylene groups having 1 to 20 carbon atoms, and arylene groups having 6 to 20 carbon atoms.

Examples of the alkyl groups having 1 to 20 carbon atoms include linear saturated hydrocarbon groups such as methyl group, ethyl group, n-propyl group, n-butyl group, n-pentyl group, n-hexyl group, n-heptyl group, n-octyl group, n-nonyl group and n-decanyl group, and branched saturated hydrocarbon groups such as isopropyl group, isobutyl group, s-butyl group, t-butyl group, t-amyl group, neopentyl group, 3-methylpentyl group, 1,1-diethylpropyl group, 1,1-dimethylbutyl group, 1-methyl-1-propylbutyl group, 1,1-propylbutyl group, 1,1-dimethyl-2-methylpropyl group, 1-methyl-1-isopropyl-2-methylpropyl group and cyclopropylmethyl group. The number of carbon atoms in the alkyl groups is preferably 1 to 6.

Examples of the cyclic saturated hydrocarbon groups having 3 to 20 carbon atoms include cyclic saturated hydrocarbon groups such as cyclopropyl group, cyclobutyl group, cyclopentyl group, cyclohexyl group, cycloheptyl group, cyclooctyl group, norbornenyl group, 1-adamantyl group and 2-adamantyl group; and groups resulting from the substitution of the cyclic saturated hydrocarbon groups with a $C_{1-17}$ hydrocarbon group in place of a hydrogen atom such as 3-methylcyclopentyl group, 3-methylcyclohexyl group, 4-methylcyclohexyl group, 4-cyclohexylcyclohexyl group and 4-phenylcyclohexyl group. The number of carbon atoms in the cyclic saturated hydrocarbon groups is preferably 5 to 11.

Examples of the chain unsaturated hydrocarbon groups having 2 to 20 carbon atoms include allyl groups, alkenyl groups such as ethenyl group (vinyl group), 1-propenyl group, 2-propenyl group (allyl group) and 1-methylethenyl group (isopropenyl group), and alkynyl groups such as ethynyl group, 1-propynyl group and 2-propynyl group (propargyl group). The number of carbon atoms in the chain unsaturated hydrocarbon groups is preferably 2 to 4.

Examples of the cyclic unsaturated hydrocarbon groups having 3 to 20 carbon atoms include cyclic unsaturated hydrocarbon groups such as cyclopentadienyl group, norbornyl group, phenyl group, naphthyl group, indenyl group, azulenyl group, phenanthryl group and anthracenyl group; groups resulting from the substitution of the cyclic unsaturated hydrocarbon groups with a $C_{1-15}$ hydrocarbon group in place of a hydrogen atom such as 3-methylphenyl group (m-tolyl group), 4-methylphenyl group (p-tolyl group), 4-ethylphenyl group, 4-t-butylphenyl group, 4-cyclohexylphenyl group, biphenylyl group, 3,4-dimethylphenyl group, 3,5-dimethylphenyl group and 2,4,6-trimethylphenyl group (mesityl group); and groups resulting from the substitution of the linear hydrocarbon groups or branched saturated hydrocarbon groups with a $C_{3-19}$ cyclic saturated hydrocarbon or cyclic unsaturated hydrocarbon group in place of a hydrogen atoms such as benzyl group and cumyl group. The number of carbon atoms in the cyclic unsaturated hydrocarbon groups is preferably 6 to 10.

Examples of the alkylene groups having 1 to 20 carbon atoms include methylene group, ethylene group, dimethylmethylene group (isopropylidene group), ethylmethylene group, methylethylene group and n-propylene group. The number of carbon atoms in the alkylene groups is preferably 1 to 6.

Examples of the arylene groups having 6 to 20 carbon atoms include o-phenylene group, m-phenylene group, p-phenylene group and 4,4'-biphenylylene group. The number of carbon atoms in the arylene groups is preferably 6 to 12.

Examples of the silicon-containing groups include groups resulting from the substitution of the $C_{1-20}$ hydrocarbon groups with a silicon atom in place of a carbon atom, specifically, alkylsilyl groups such as trimethylsilyl group, triethylsilyl group, t-butyldimethylsilyl group and triisopropylsilyl group; arylsilyl groups such as dimethylphenylsilyl group, methyldiphenylsilyl group and t-butyldiphenylsilyl group; and pentamethyldisilanyl group and trimethylsilylmethyl group. The number of carbon atoms in the alkylsilyl groups is preferably 1 to 10, and the number of carbon atoms in the arylsilyl groups is preferably 6 to 18.

Examples of the nitrogen-containing groups include amino group; groups resulting from the substitution of the aforementioned $C_{1-20}$ hydrocarbon groups or silicon-containing groups with a nitrogen atom in place of a =CH— structural unit, with a nitrogen atom, to which a $C_{1-20}$ hydrocarbon group is bound, in place of a —$CH_2$— structural unit, or with a nitrile group or a nitrogen atom, to which $C_{1-20}$ hydrocarbon groups are bound, in place of a —$CH_3$ structural unit such as dimethylamino group, diethylamino group, N-morpholinyl group, dimethylaminomethyl group, cyano group, pyrrolidinyl group, piperidinyl group and pyridinyl group; and N-morpholinyl group and nitro group. Preferred nitrogen-containing groups are dimethylamino group and N-morpholinyl group.

Examples of the oxygen-containing groups include hydroxyl group, and groups resulting from the substitution of the aforementioned $C_{1-20}$ hydrocarbon groups, silicon-containing groups or nitrogen-containing groups with an oxygen atom or a carbonyl group in place of a —$CH_2$- structural unit, or with an oxygen atom bonded to a $C_{1-20}$ hydrocarbon group in place of a —$CH_3$ structural unit such as methoxy group, ethoxy group, t-butoxy group, phenoxy group, trimethylsiloxy group, methoxyethoxy group, hydroxymethyl group, methoxymethyl group, ethoxymethyl group, t-butoxymethyl group, 1-hydroxyethyl group, 1-methoxyethyl group, 1-ethoxyethyl group, 2-hydroxyethyl group, 2-methoxyethyl group, 2-ethoxyethyl group, n-2-oxabutylene group, n-2-oxapentylene group, n-3-oxapentylene group, aldehyde group, acetyl group, propionyl group, benzoyl group, trimethylsilylcarbonyl group, carbamoyl group, methylaminocarbonyl group, carboxy group, methoxycarbonyl group, carboxymethyl group, ethocarboxymethyl group, carbamoylmethyl group, furanyl group and pyranyl group. A preferred oxygen-containing group is methoxy group.

Examples of the halogen atoms include Group XVII elements such as fluorine, chlorine, bromine and iodine.

Examples of the halogen-containing groups include groups resulting from the substitution of the aforementioned $C_{1-20}$ hydrocarbon groups, silicon-containing groups, nitrogen-containing groups or oxygen-containing groups with a halogen atom in place of a hydrogen atom such as trifluoromethyl group, tribromomethyl group, pentafluoroethyl group and pentafluorophenyl group.

Q is a halogen atom, a hydrocarbon group having 1 to 20 carbon atoms, an anionic ligand or a neutral ligand capable of coordination through a lone pair of electrons, and may be the same or different.

The details of the halogen atoms and the hydrocarbon groups having 1 to 20 carbon atoms are as described above. When Q is a halogen atom, a chlorine atom is preferable. When Q is a hydrocarbon group having 1 to 20 carbon atoms, the number of carbon atoms in the hydrocarbon group is preferably 1 to 7.

Examples of the anionic ligands include alkoxy groups such as methoxy group, t-butoxy group and phenoxy group, carboxylate groups such as acetate and benzoate, and sulfonate groups such as mesylate and tosylate.

Examples of the neutral ligands capable of coordination through a lone pair of electrons include organophosphorus compounds such as trimethylphosphine, triethylphosphine, triphenylphosphine and diphenylmethylphosphine, and ether compounds such as tetrahydrofuran, diethyl ether, dioxane and 1,2-dimethoxyethane.

The letter j is an integer of 1 to 4, and preferably 2.

The letter n is an integer of 1 to 4, preferably 1 or 2, and more preferably 1.

$R^{13}$ and $R^{14}$ are each an atom or a substituent selected from the group consisting of a hydrogen atom, a hydrocarbon group having 1 to 20 carbon atoms, an aryl group, a substituted aryl group, a silicon-containing group, a nitrogen-containing group, an oxygen-containing group, a halogen atom and a halogen-containing group, and may be the same as or different from each other. $R^{13}$ and $R^{14}$ may be bonded together to form a ring or may not be bonded to each other.

The details of the hydrocarbon groups having 1 to 20 carbon atoms, the silicon-containing groups, the nitrogen-containing groups, the oxygen-containing groups, the halogen atoms and the halogen-containing groups are as described hereinabove.

Examples of the aryl groups include substituents derived from aromatic compounds such as phenyl group, 1-naphthyl group, 2-naphthyl group, anthracenyl group, phenanthrenyl group, tetracenyl group, chrysenyl group, pyrenyl group, indenyl group, azulenyl group, pyrrolyl group, pyridyl group, furanyl group and thiophenyl group. Some of these aryl groups overlap with some of the aforementioned cyclic unsaturated hydrocarbon groups having 3 to 20 carbon atoms. Preferred aryl groups are phenyl group and 2-naphthyl group.

Examples of the aromatic compounds include aromatic hydrocarbons and heterocyclic aromatic compounds such as benzene, naphthalene, anthracene, phenanthrene, tetracene, chrysene, pyrene, indene, azulene, pyrrole, pyridine, furan and thiophene.

Examples of the substituted aryl groups include groups resulting from the substitution of the above aryl groups with at least one substituent selected from the group consisting of hydrocarbon groups having 1 to 20 carbon atoms, aryl groups, silicon-containing groups, nitrogen-containing groups, oxygen-containing groups, halogen atoms and halogen-containing groups in place of one or more hydrogen atoms in the aryl groups. Specific examples include 3-methylphenyl group (m-tolyl group), 4-methylphenyl group (p-tolyl group), 3-ethylphenyl group, 4-ethylphenyl group, 3,4-dimethylphenyl group, 3,5-dimethylphenyl group, biphenylyl group, 4-(trimethylsilyl)phenyl group, 4-aminophenyl group, 4-(dimethylamino)phenyl group, 4-(diethylamino)phenyl group, 4-morpholinylphenyl group, 4-methoxyphenyl group, 4-ethoxyphenyl group, 4-phenoxyphenyl group, 3,4-dimethoxyphenyl group, 3,5-dimethoxyphenyl group, 3-methyl-4-methoxyphenyl group, 3,5-dimethyl-4-methoxyphenyl group, 3-(trifluoromethyl)phenyl group, 4-(trifluoromethyl)phenyl group, 3-chlorophenyl group, 4-chlorophenyl group, 3-fluorophenyl group, 4-fluorophenyl group, 5-methylnaphthyl group and 2-(6-methyl) pyridyl group. Some of these substituted aryl groups overlap with some of the aforementioned cyclic unsaturated hydrocarbon groups having 3 to 20 carbon atoms.

In the bridged metallocene compound (a) represented by the above formula [I], n is preferably 1. Such bridged metallocene compounds (hereinafter, also written as the "bridged metallocene compounds (a-1)") are represented by the following general formula [II].

[Chem. 2]

[II]

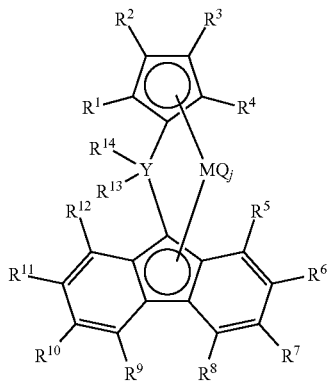

In the formula [II], Y, M, $R^1$, $R^2$, $R^3$, $R^4$, $R^5$, $R^6$, $R^7$, $R^8$, $R^9$, $R^{10}$, $R^{11}$, $R^{12}$, $R^{13}$, $R^{14}$, Q and j are as defined and described hereinabove.

The bridged metallocene compound (a-1) may be produced through simplified steps at low production cost as compared to the compounds of the formula [I] in which n is an integer of 2 to 4. Thus, the use of such a bridged metallocene compound (a-1) is advantageous in that the costs associated with the production of the ethylene/α-olefin copolymer (C) are reduced.

In the bridged metallocene compound (a-1) represented by the formula [II] above, it is preferable that $R^1$, $R^2$, $R^3$ and $R^4$ be all hydrogen atoms. Such bridged metallocene compounds (hereinafter, also written as the "bridged metallocene compounds (a-2)") are represented by the following general formula [III].

[Chem. 3]

[III]

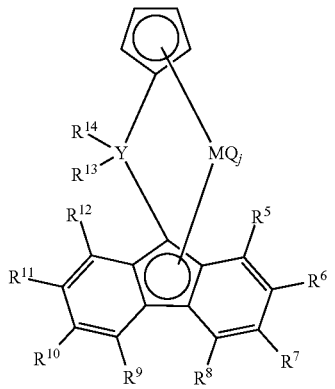

In the formula [III], Y, M, $R^5$, $R^6$, $R^7$, $R^8$, $R^9$, $R^{10}$, $R^{11}$, $R^{12}$, $R^{13}$, $R^{14}$, Q and j are as defined and described hereinabove.

The bridged metallocene compound (a-2) may be produced through simplified steps at low production cost as compared to the compounds of the formula [I] in which one or more of $R^1$, $R^2$, $R^3$ and $R^4$ are substituents other than hydrogen atoms. Thus, the use of such a bridged metallocene compound (a-2) is advantageous in that the costs for the production of ethylene/α-olefin copolymers (C) are reduced. In contrast to a general knowledge that the randomness of ethylene/α-olefin copolymers (C) is decreased at high polymerization temperatures, copolymerization of ethylene with one or more monomers selected from $C_{3-20}$ α-olefins in the presence of the olefin polymerization catalyst including the bridged metallocene compound (a-2) advantageously affords an ethylene/α-olefin copolymer (C) with high randomness even at a high polymerization temperature.

In the bridged metallocene compound (a-2) represented by the formula [III] above, it is preferable that one of $R^{13}$ and $R^{14}$ be an aryl group or a substituted aryl group. Such a bridged metallocene compound (a-3) provides an advantage that the number of unsaturated bonds in the obtainable ethylene/α-olefin copolymer (C) is small as compared to when $R^{13}$ and $R^{14}$ are both substituents other than aryl groups and substituted aryl groups.

The bridged metallocene compound (a-3) is more preferably such that one of $R^{13}$ and $R^{14}$ is an aryl group or a substituted aryl group and the other is an alkyl group having 1 to 20 carbon atoms, and is particularly preferably such that one of $R^{13}$ and $R^{14}$ is an aryl group or a substituted aryl group and the other is a methyl group. Such a bridged metallocene compound (hereinafter, also written as the "bridged metallocene compound (a-4)") provides advantages that the balance between the polymerization activity and the number of unsaturated bonds in the obtainable ethylene/α-olefin copolymer (C) is excellent and the use of the bridged metallocene compound allows for the reduction of costs associated with the production of ethylene/α-olefin copolymers (C) as compared to when $R^{13}$ and $R^{14}$ are both aryl groups or substituted aryl groups.

When polymerization is performed at a given total pressure in a polymerizer and at a given temperature, increasing the hydrogen partial pressure by the introduction of hydrogen is accompanied by a decrease in the partial pressures of olefin monomers to be polymerized and consequently the polymerization rate is disadvantageously depressed particularly when the hydrogen partial pressure is high. Because the total pressure acceptable inside a polymerization reactor is limited for design reasons, any excessive introduction of hydrogen during the production of olefin polymers, in particular, as required for the production of olefin polymers having a low molecular weight, significantly decreases the olefin partial pressure and possibly results in a decrease in polymerization activity. In contrast, the use of the bridged metallocene compound (a-4) allows the ethylene/α-olefin copolymer (C) to be produced with a reduced amount of hydrogen introduced into the polymerization reactor and thus with an enhanced polymerization activity as compared to when the bridged metallocene compound (a-3) is used, thereby providing an advantage that the costs associated with the production of ethylene/α-olefin copolymers (C) are reduced.

In the bridged metallocene compound (a-4), $R^6$ and $R^{11}$ are preferably each an alkyl group having 1 to 20 carbon atoms or an alkylene group having 1 to 20 carbon atoms and may be bonded to any of the adjacent substituents to form a ring. Such a bridged metallocene compound (hereinafter, also written as the "bridged metallocene compound (a-5)") may be produced through simplified steps at low production cost as compared to the compounds in which $R^6$ and $R^{11}$ are substituents other than alkyl groups having 1 to 20 carbon atoms and alkylene groups having 1 to 20 carbon atoms. Thus, the use of such a bridged metallocene compound (a-5) is advantageous in that the costs associated with the production of ethylene/α-olefin copolymers (C) are reduced.

In the bridged metallocene compound (a) represented by the general formula [I], the bridged metallocene compound (a-1) represented by the general formula [II], the bridged metallocene compound (a-2) represented by the general formula [III], and the bridged metallocene compounds (a-3), (a-4) and (a-5), it is more preferable that M be a zirconium atom. When M is a zirconium atom, copolymerization of ethylene with one or more monomers selected from $C_{3-20}$ α-olefins in the presence of the olefin polymerization catalyst including such a bridged metallocene compound attains high polymerization activity as compared to when M is a titanium atom or a hafnium atom, thus providing an advantage that the costs associated with the production of ethylene/α-olefin copolymers (C) are reduced.

Examples of the bridged metallocene compounds (a) include:

[dimethylmethylene($\eta^5$-cyclopentadienyl)($\eta^5$-fluorenyl)]zirconium dichloride, [dimethylmethylene($\eta^5$-cyclopentadienyl)($\eta^5$-2,7-di-t-butylfluorenyl)]zirconium dichloride, [dimethylmethylene($\eta^5$-cyclopentadienyl)($\eta^5$-3,6-di-t-butylfluorenyl)]zirconium dichloride, [dimethylmethylene ($\eta^5$-cyclopentadienyl)($\eta^5$-octamethyloctahydrodibenzofluorenyl)]zirconium dichloride, [dimethylmethylene($\eta^5$-cyclopentadienyl)($\eta^5$-tetramethyloctahydrodibenzofluorenyl)]zirconium dichloride,

[cyclohexylidene($\eta^5$-cyclopentadienyl)($\eta^5$-fluorenyl)]zirconium dichloride, [cyclohexylidene($\eta^5$-cyclopentadienyl)($\eta^5$-2,7-di-t-butylfluorenyl)]zirconium dichloride, [cyclohexylidene($\eta^5$-cyclopentadienyl)($\eta^5$-3,6-di-t-butylfluorenyl)]zirconium dichloride, [cyclohexylidene($\eta^5$-cyclopentadienyl)($\eta^5$-octamethyloctahydrodibenzofluorenyl)]zirconium dichloride, [cyclohexylidene($\eta^5$-cyclopentadienyl)($\eta^5$-tetramethyloctahydrodibenzofluorenyl)]zirconium dichloride,

[diphenylmethylene($\eta^5$-cyclopentadienyl)($\eta^5$-fluorenyl)]zirconium dichloride, [diphenylmethylene($\eta^5$-cyclopentadienyl)($\eta^5$-2,7-di-t-butylfluorenyl)]zirconium dichloride, [diphenylmethylene($\eta^5$-2-methyl-4-t-butylcyclopentadienyl)($\eta^5$-2,7-di-t-butylfluorenyl)]zirconium dichloride, [diphenylmethylene($\eta^5$-cyclopentadienyl)($\eta^5$-3,6-di-t-butylfluorenyl)]zirconium dichloride, [diphenylmethylene ($\eta^5$-cyclopentadienyl)($\eta^5$-octamethyloctahydrodibenzofluorenyl)]zirconium dichloride, diphenylmethylene{$\eta^5$-(2-methyl-4-i-propylcyclopentadienyl)}($\eta^5$-octamethyloctahydrodibenzofluorenyl)]zirconium dichloride, [diphenylmethylene($\eta^5$-cyclopentadienyl)($\eta^5$-tetramethyloctahydrodibenzofluorenyl)]zirconium dichloride,

[methylphenylmethylene($\eta^5$-cyclopentadienyl)($\eta^5$-fluorenyl)]zirconium dichloride, [methylphenylmethylene($\eta^5$-cyclopentadienyl)($\eta^5$-2,7-di-t-butylfluorenyl)]zirconium dichloride, [methylphenylmethylene($\eta^5$-cyclopentadienyl)($\eta^5$-3,6-di-t-butylfluorenyl)]zirconium dichloride, [methylphenylmethylene($\eta^5$-cyclopentadienyl)($\eta^5$-octamethyloctahydrodibenzofluorenyl)]zirconium dichloride, [methylphenylmethylene($\eta^5$-cyclopentadienyl)($\eta^5$-tetramethyloctahydrodibenzofluorenyl)]zirconium dichloride,

[methyl(3-methylphenyl)methylene($\eta^5$-cyclopentadienyl)($\eta^5$-fluorenyl)]zirconium dichloride, [methyl(3-methylphenyl)methylene ($\eta^5$-cyclopentadienyl)($\eta^5$-2,7-di-t-butylfluorenyl)]zirconium dichloride, [methyl(3-methylphenyl)methylene($\eta^5$-cyclopentadienyl)($\eta^5$-3,6-di-t-butylfluorenyl)]zirconium dichloride, [methyl(3-methylphenyl)methylene($\eta^5$-cyclopentadienyl)($\eta^5$-octamethyloctahydrodibenzofluorenyl)]zirconium dichloride, [methyl(3-methylphenyl)methylene($\eta^5$-cyclopentadienyl)($\eta^5$-tetramethyloctahydrodibenzofluorenyl)]zirconium dichloride,

[diphenylsilylene($\eta^5$-cyclopentadienyl)($\eta^5$-fluorenyl)]zirconium dichloride, [diphenylsilylene($\eta^5$-cyclopentadienyl)($\eta^5$-2,7-di-t-butylfluorenyl)]zirconium dichloride, [diphenylsilylene($\eta^5$-cyclopentadienyl)($\eta^5$-3,6-di-t-butylfluorenyl)]zirconium dichloride, [diphenylsilylene($\eta^5$-cyclopentadienyl)($\eta^5$-octamethyloctahydrodibenzofluorenyl)]zirconium dichloride, [diphenylsilylene($\eta^5$-cyclopentadienyl)($\eta^5$-tetramethyloctahydrodibenzofluorenyl)]zirconium dichloride,

[bis(3-methylphenyl)silylene($\eta^5$-cyclopentadienyl)($\eta^5$-fluorenyl)]zirconium dichloride, [bis(3-methylphenyl)silylene($\eta^5$-cyclopentadienyl)($\eta^5$-2,7-di-t-butylfluorenyl)]zirconium dichloride, [bis(3-methylphenyl)silylene($\eta^5$-cyclopentadienyl)($\eta^5$-3,6-di-t-butylfluorenyl)]zirconium dichloride, [bis(3-methylphenyl)silylene($\eta^5$-cyclopentadienyl)($\eta^5$-octamethyloctahydrodibenzofluorenyl)]zirconium dichloride, [bis(3-methylphenyl)silylene($\eta^5$-cyclopentadienyl)($\eta^5$-tetramethyloctahydrodibenzofluorenyl)]zirconium dichloride,

[dicyclohexylsilylene ($\eta^5$-cyclopentadienyl)($\eta^5$-fluorenyl)]zirconium dichloride, [dicyclohexylsilylene($\eta^5$-cyclopentadienyl)($\eta^5$-2,7-di-t-butylfluorenyl)]zirconium dichloride, [dicyclohexylsilylene($\eta^5$-cyclopentadienyl)($\eta^5$-3,6-di-t-butylfluorenyl)]zirconium dichloride, [dicyclohexylsilylene ($\eta^5$-cyclopentadienyl)($\eta^5$-octamethyloctahydrodibenzofluorenyl)]zirconium dichloride, [dicyclohexylsilylene ($\eta^5$-cyclopentadienyl)($\eta^5$-tetramethyloctahydrodibenzofluorenyl)]zirconium dichloride,

[ethylene($\eta^5$-cyclopentadienyl)($\eta^5$-fluorenyl)]zirconium dichloride, [ethylene($\eta^5$-cyclopentadienyl)($\eta^5$-2,7-di-t-butylfluorenyl)]zirconium dichloride, [ethylene($\eta^5$-cyclopentadienyl)($\eta^5$-3,6-di-t-butylfluorenyl)]zirconium dichloride, [ethylene($\eta^5$-cyclopentadienyl)($\eta^5$-octamethyloctahydrodibenzofluorenyl)]zirconium dichloride and [ethylene($\eta^5$-cyclopentadienyl)($\eta^5$-tetramethyloctahydrodibenzofluorenyl)]zirconium dichloride.

Examples further include compounds corresponding to the above compounds except that the zirconium atom is replaced by a hafnium atom or except that the chloro ligand is replaced by a methyl group. The bridged metallocene compounds (a) are not limited to the examples described above. In the bridged metallocene compounds (a) described above, $\eta^5$-tetramethyloctahydrodibenzofluorenyl indicates 4,4,7,7-tetramethyl-(5a,5b,11a,12,12a-$\eta^5$)-1,2,3,4,7,8,9,10-octahydrodibenzo[b,H]fluorenyl group, and $\eta^5$-octamethyloctahydrodibenzofluorenyl indicates 1,1,4,4,7,7,10,10-octamethyl-(5a,5b,11a,12,12a-$\eta^5$)-1,2,3,4,7,8,9,10-octahydrodibenzo[b,H]fluorenyl group.

<Compounds (b)>

The polymerization catalyst used in the invention includes the bridged metallocene compound (a) described above, and at least one compound (b) selected from the group consisting of organometallic compounds (b-1), organoaluminum oxy compounds (b-2) and compounds (b-3) capable of reacting with the bridged metallocene compound (a) to form an ion pair.

Specifically, organometallic compounds of Group 1, 2, 12 and 13 metals in the periodic table described below may be used as the organometallic compounds (b-1).

(b-1a) Organoaluminum compounds represented by the general formula: $R^a_mAl(OR^b)_nH_pX_q$, wherein $R^a$ and $R^b$, which may be the same as or different from each other, are each a hydrocarbon group having 1 to 15, or preferably 1 to 4 carbon atoms, X is a halogen atom, $0<m\leq3$, $0\leq n<3$, $0\leq p<3$, $0\leq q<3$, and $m+n+p+q=3$ Examples of such a compound include:

tri-n-alkylaluminums such as trimethylaluminum, triethylaluminum, tri-n-butylaluminum, tri-n-hexylaluminum and tri-n-octylaluminum;

tri-branched-alkylaluminums such as triisopropylaluminum, triisobutylaluminum, trisec-butylaluminum, tri-t-butylaluminum, tri-2-methylbutylaluminum, tri-3-methylhexylaluminum and tri-2-ethylhexylaluminum;

tricycloalkylaluminums such as tricyclohexylaluminum and tricyclooctylaluminum;

triarylaluminums such as triphenylaluminum and tri(4-methylphenyl)aluminum;

dialkylaluminumhydrides such as diisopropylaluminumhydride and diisobutylaluminumhydride;

alkenylaluminum represented by the general formula $(i\text{-}C_4H_9)_xAl_y(C_5H_{10})_z$, wherein x, y and z are positive numbers, and $z \leq 2x$, such as isoprenylaluminum;

alkylaluminumalkoxides such as isobutylaluminummethoxide and isobutylaluminumethoxide;

dialkylaluminumalkoxides such as dimethylaluminummethoxide, diethylaluminumethoxide and dibutylaluminumbutoxide;

alkylaluminumsesquialkoxides such as ethylaluminumsesquiethoxide and butylaluminumsesquibutoxide;

partially alkoxylated alkylaluminums having an average composition represented by the general formula $R^a_{2.5}Al(OR^b)_{0.5}$ and the like;

alkylaluminumaryloxides such as diethylaluminumphenoxide and diethylaluminum(2,6-di-t-butyl-4-methylphenoxide);

dialkylaluminumhalides such as dimethylaluminumchloride, diethylaluminumchloride, dibutylaluminumchloride, diethylaluminumbromide and diisobutylaluminumchloride;

alkylaluminumsesquihalides such as ethylaluminumsesquichloride, butylaluminumsesquichloride and ethylaluminumsesquibromide;

partially halogenated alkylaluminums including alkylaluminumdihalide such as ethylaluminumdichloride;

dialkylaluminumhydrides such as diethylaluminumhydride and dibutylaluminumhydride;

alkylaluminumdihydrides such as ethylaluminumdihydride and propylaluminumdihydride, and other partially hydrogenate alkylaluminum, and partially alcoxylated and halogenated alkylaluminums such as ethylaluminumethoxychloride, butylaluminumbutoxychloride and ethylaluminumethoxybromide.

Compounds similar to the compounds represented by the general formula $R^a_mAl(OR^b)_nH_pX_q$ can also be used, examples of which compounds including an organoaluminum compound wherein two or more aluminum compounds are bound via a nitrogen atom. Examples of such a compound specifically include $(C_2H_5)_2AlN\ C_2H_5)Al(C_2H_5)_2$, and the like.

(b-1b) A complex alkylated compound of a metal of Group 1 of the periodic table and aluminum, represented by the general formula: $M^2AlR^a_4$, wherein $M^2$ is Li, Na or K; and $R^a$ is a hydrocarbon group having 1 to 15 carbon atoms, preferably a hydrocarbon group having 1 to 4 carbon atoms.

Examples of such a compound include $LiAl(C_2H_5)_4$, $LiAl(C_7H_{15})_4$, and the like.

(b-1c) A dialkyl compound of a metal of Group 2 or 12 of the periodic table, represented by the general formula: $R^aR^bM^3$, wherein $R^a$ and $R^b$, each of which may be the same or different, are a hydrocarbon group having 1 to 15 carbon atoms, preferably a hydrocarbon group having 1 to 4 carbon atoms; and $M^3$ is Mg, Zn or Cd.

As the organoaluminum oxy compound (b-2), a conventionally known aluminoxane can be used as it is. Specifically, examples of such a compound include compounds represented by the general formula [IV] and/or the general formula [V].

[Chem. 4]

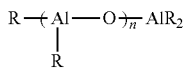

[IV]

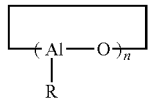

[V]

In the formulas [IV] and [V], R is a hydrocarbon group having 1 to 10 carbon atoms and n is an integer of 2 or more.

In particular, a methylaluminoxane wherein R is a methyl group and wherein n is 3 or more, preferably 10 or more, is used. These aluminoxanes may have a slight amount of organoaluminum compounds mixed thereinto.

When, in the present invention, ethylene and an α-olefin having three or more carbon atoms are copolymerized at high temperature, benzene-insoluble organoaluminum oxy compounds such as those exemplified in patent literature JP-A No. H02-78687 may also be applied. In addition, organoaluminum oxy compounds described in JP-A-H02-167305, aluminoxanes having two or more kinds of alkyl groups described in JP-A-H02-24701 and JP-A-H03-103407, and the like may also be preferably utilized. The "benzene-insoluble organoaluminum oxy compound", which may be used in the present invention, has an Al content dissolved in benzene at 60° C. typically at 10% or less, preferably 5% or less, particularly preferably 2% or less based on the conversion to Al atoms, and is an insoluble or poorly-soluble compound to benzene.

Examples of the organoaluminum oxy compounds (b-2) also include modified methylaluminoxanes such as the one represented by the following general formula [VI].

[Chem. 5]

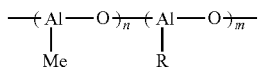

[VI]

In the formula [VI], R is a hydrocarbon group having 1 to 10 carbon atoms and each of m and n is independently an integer of 2 or more.

This modified methylaluminoxane is prepared using trimethylaluminum and an alkylaluminum other than trimethylaluminum. Such a compound is generally referred to as MMAO. Such MMAO can be prepared by a method described in U.S. Pat. Nos. 4,960,878 and 5,041,584. A compound which is prepared using trimethylaluminum and triisobutylaluminum wherein R is an isobutyl group is also commercially available for example under the name of MMAO, TMAO, and the like from Tosoh Finechem Corporation. Such MMAO is an aluminoxane whose solubility with respect to various solvents and preservation stability have been improved, and is soluble in an aliphatic hydrocarbon or an alicyclic hydrocarbon, specifically unlike the compounds which are insoluble or poorly-soluble to benzene among the compounds represented by the formulas [IV] and [V].

Further, examples of the organoaluminum oxy compounds (b-2) also include boron-containing organoaluminum oxy compounds represented by the general formula [VII].

[Chem. 6]

[VII]

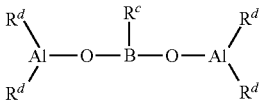

In the formula [VII], $R^c$ is a hydrocarbon group having 1 to 10 carbon atoms; and $R^d$ may each be the same or different and is a hydrogen atom, a halogen atom or a hydrocarbon group having 1 to 10 carbon atoms.

Examples of the compounds (b-3) capable of reacting with the bridged metallocene compound (a) to form an ion pair (hereinafter may be referred to as "ionized ionic compound" or simply "ionic compound" for short) include Lewis acids, ionic compounds, borane compounds and carborane compounds described in JP-A-H01-501950, JP-A-H01-502036, JP-A-H03-179005, JP-A-H03-179006, JP-A-H03-207703, JP-A-H03-207704, U.S. Pat. No. 5,321,106, and so on. Further examples include heteropoly compounds and isopoly compounds.

The ionized ionic compounds preferably used in the present invention are boron compounds represented by the following general formula [VIII].

[Chem. 7]

[VIII]

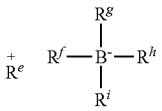

In the formula [VIII], $R^{e+}$ is $H^+$, carbenium cation, oxonium cation, ammonium cation, phosphonium cation, cycloheptyltrienyl cation, ferrocenium cation containing a transition metal, or the like. $R^f$ to $R^i$ may be the same as or different from each other and are each a substituent selected from hydrocarbon groups having 1 to 20 carbon atoms, silicon-containing groups, nitrogen-containing groups, oxygen-containing groups, halogen atoms and halogen-containing groups, and preferably a substituted aryl group.

Specific examples of the carbenium cations include tri-substituted carbenium cations, such as triphenylcarbenium cation, tris(4-methylphenyl)carbenium cation and tris(3,5-dimethylphenyl) carbenium cation.

Specific examples of the ammonium cations include trialkyl-substituted ammonium cations such as trimethylammonium cation, triethylammonium cation, tri(n-propyl)ammonium cation, triisopropylammonium cation, tri(n-butyl) ammonium cation and triisobutylammonium cation; N,N-dialkylanilinium cations such as N,N-dimethylanilinium cation, N,N-diethylanilinium cation and N,N-2,4,6-pentamethylanilinium cation; and dialkylammonium cations such as diisopropylammonium cation and dicyclohexylammonium cation.

Specific examples of the phosphonium cations include triarylphosphonium cations such as triphenylphosphonium cation, tris(4-methylphenyl)phosphonium cation and tris(3,5-dimethylphenyl)phosphonium cation.

Of the above specific examples, carbenium cation, ammonium cation and the like are preferable as $R^{e+}$, and in particular, triphenylcarbenium cation, N,N-dimethylanilinium cation and N,N-diethylanilinium cation are preferable.

Examples of compounds containing carbenium cation, among the ionized ionic compounds preferably used in the present invention, include triphenylcarbenium tetraphenylborate, triphenylcarbenium tetrakis(pentafluorophenyl)borate, triphenylcarbenium tetrakis[3,5-di-(trifluoromethyl) phenyl]borate, tris(4-methylphenyl)carbenium tetrakis (pentafluorophenyl)borate and tris(3,5-dimethylphenyl) carbenium tetrakis(pentafluorophenyl)borate.

Examples of compounds containing a trialkyl-substituted ammonium cation, among the ionized ionic compounds preferably used in the present invention, include triethylammonium tetraphenylborate, tripropylammonium tetraphenylborate, tri(n-butyl)ammonium tetraphenylborate, trimethylammonium tetrakis(4-methylphenyl)borate, trimethylammonium tetrakis(2-methylphenyl)borate, tri(n-butyl)ammonium tetrakis(pentafluorophenyl)borate, triethylammonium tetrakis(pentafluorophenyl)borate, tripropylammonium tetrakis(pentafluorophenyl)borate, tripropylammonium tetrakis(2,4-dimethylphenyl)borate, tri (n-butyl)ammonium tetrakis(3,5-dimethylphenyl)borate, tri (n-butyl)ammonium tetrakis[4-(trifluoromethyl)phenyl]borate, tri(n-butyl)ammonium tetrakis[3,5-di(trifluoromethyl) phenyl]borate, tri(n-butyl)ammonium tetrakis(2-methylphenyl)borate, dioctadecylmethylammonium tetraphenylborate, dioctadecylmethylammonium tetrakis(4-methylphenyl)borate, dioctadecylmethylammonium tetrakis (4-methylphenyl)borate, dioctadecylmethylammonium tetrakis(pentafluorophenyl)borate, dioctadecylmethylammonium tetrakis(2,4-dimethylphenyl) borate, dioctadecylmethylammonium tetrakis(3,5-dimethylphenyl)borate, dioctadecylmethylammonium tetrakis[4-(trifluoromethyl)phenyl]borate, dioctadecylmethylammonium tetrakis[3,5-di(trifluoromethyl)phenyl]borate and dioctadecylmethylammonium.

Examples of compounds containing a N,N-dialkylanilinium cation, among the ionized ionic compounds preferably used in the present invention, include N,N-dimethylanilinium tetraphenylborate, N,N-dimethylanilinium tetrakis(pentafluorophenyl)borate, N,N-dimethylanilinium tetrakis[3,5-di(trifluoromethyl)phenyl]borate, N,N-diethylanilinium tetraphenylborate, N,N-diethylanilinium tetrakis (pentafluorophenyl)borate, N,N-diethylanilinium tetrakis[3,5-di(trifluoromethyl)phenyl]borate, N,N-2,4,6-pentamethylanilinium tetraphenylborate and N,N-2,4,6-pentamethylanilinium tetrakis(pentafluorophenyl)borate.

Examples of compounds containing a dialkylammonium cation, among the ionized ionic compounds preferably used in the present invention, include di-n-propylammonium tetrakis(pentafluorophenyl)borate and dicyclohexylammonium tetraphenylborate.

Ionic compounds exemplified in JP-A-2004-51676 are also employable without any restriction.

The ionic compounds (b-3) may be used singly, or two or more kinds thereof may be mixed and used.

The organometallic compounds (b-1) are preferably trimethylaluminum, triethylaluminum and triisobutylaluminum, which are easily obtainable as commercial products. Of these, triisobutylaluminum, which is easy to handle, is particularly preferable.

The organoaluminum oxy compounds (b-2) are preferably methylaluminoxane, which is easily obtainable as a commercial product, and MMAO, which is prepared using trimethylaluminum and triisobutylaluminum. Among these, MMAO, whose solubility to various solvents and preservation stability have been improved, is particularly preferable.

The ionic compounds (b-3) are preferably triphenylcarbenium tetrakis(pentafluorophenyl)borate and N,N-dimethylanilinium tetrakis(pentafluorophenyl)borate, which are easily obtainable as commercial products and greatly contributory to improvement in polymerization activity.

As the compound (b), a combination of triisobutylaluminum and triphenylcarbenium tetrakis(pentafluorophenyl) borate, and a combination of triisobutylaluminum and N,N-dimethylanilinium tetrakis(pentafluorophenyl) borate are particularly preferable because the polymerization activity is markedly enhanced.

<Carrier (c)>

In the present invention, a carrier (c) may be used as a constituent of the olefin polymerization catalyst, when needed.

The carrier (c) that may be used in the present invention is an inorganic or organic compound and is a granular or fine particulate solid. Of such inorganic compounds, porous oxides, inorganic chlorides, clays, clay minerals or ion-exchanging layered compounds are preferable.

As the porous oxides, $SiO_2$, $Al_2O_3$, MgO, ZrO, $TiO_2$, $B_2O_3$, CaO, ZnO, BaO, $ThO_2$ and the like, and composites or mixtures containing these oxides, such as natural or synthetic zeolite, $SiO_2$—MgO, $SiO_2$—$Al_2O_3$, $SiO_2$—$TiO_2$, $SiO_2$—$V_2O_5$, $SiO_2$—$Cr_2O_3$ and $SiO_2$—$TiO_2$—MgO, can be specifically used. Of these, porous oxides containing $SiO_2$ and/or $Al_2O_3$ as a main component are preferable. Such porous oxides differ in their properties depending upon the type and the production process, but a carrier preferably used in the present invention has a particle diameter of 0.5 to 300 μm, preferably 1.0 to 200 μm, a specific surface area of 50 to 1000 $m^2/g$, preferably 100 to 700 $m^2/g$, and a pore volume of 0.3 to 3.0 $cm^3/g$. Such a carrier is used after it is calcined at 100 to 1000° C., preferably 150 to 700° C., when needed.

As the inorganic chlorides, $MgCl_2$, $MgBr_2$, $MnCl_2$, $MnBr_2$ or the like is used. The inorganic chloride may be used as it is, or may be used after pulverized by a ball mill or an oscillating mill. Further, fine particles obtained by dissolving an inorganic chloride in a solvent such as an alcohol and then precipitating it using a precipitant may be used.

The clay usually comprises a clay mineral as a main component. The ion-exchanging layered compound is a compound having a crystal structure in which constituent planes lie one upon another in parallel and are bonded to each other by ionic bonding or the like with a weak bonding force, and the ions contained are exchangeable. Most of the clay minerals are ion-exchanging layered compounds. These clay, clay mineral and ion-exchanging layered compound are not limited to natural ones, and artificial synthetic products can be also used. Examples of the clays, the clay minerals and the ion-exchanging layered compounds include clays, clay minerals and ionic crystalline compounds having layered crystal structures such as hexagonal closest packing type, antimony type, $CdCl_2$ type and CdI2 type. Examples of such clays and clay minerals include kaolin, bentonite, Kibushi clay, Gairome clay, allophane, hisingerite, pyrophyllite, micas, montmorillonites, vermiculite, chlorites, palygorskite, kaolinite, nacrite, dickite and halloysite. Examples of the ion-exchanging layered compounds include crystalline acidic salts of polyvalent metals, such as α-Zr$(HAsO_4)_2.H_2O$, α-Zr$(HPO_4)_2$, α-Zr$(KPO_4)_2.3H_2O$, α-Ti$(HPO_4)_2$, α-Ti$(HAsO_4)_2.H_2O$, α-Sn$(HPO_4)_2.H_2O$, γ-Zr$(HPO_4)_2$, γ-Ti$(HPO_4)_2$ and γ-Ti$(NH_4PO_4)_2.H_2O$. It is also preferable to subject the clays and the clay minerals for use in the present invention to chemical treatment. Any chemical treatments such as surface treatments to remove impurities adhering to a surface and treatments having influence on the crystal structure of clay can be used. Specific examples of the chemical treatments include acid treatment, alkali treatment, salts treatment and organic substance treatment.

The ion-exchanging layered compound may be a layered compound in which spacing between layers has been enlarged by exchanging exchangeable ions present between layers with other large bulky ions. Such a bulky ion plays a pillar-like role to support a layer structure and is usually called pillar. Introduction of another substance (guest compound) between layers of a layered compound as above is referred to as "intercalation". Examples of the guest compounds include cationic inorganic compounds such as $TiCl_4$ and $ZrCl_4$, metallic alkoxides such as $Ti(OR)_4$, $Zr(OR)_4$, $PO(OR)_3$ and $B(OR)_3$ (R is a hydrocarbon group or the like), and metallic hydroxide ions such as $[Al_{13}O_4(OH)_{24}]^{7+}$, $[Zr_4(OH)_{14}]^{2+}$ and $[Fe_3O(OCOCH_3)_6]^+$. These compounds are used singly or in combination of two or more kinds. During intercalation of these compounds, polymerization products obtained by subjecting metallic alkoxides such as $Si(OR)_4$, $Al(OR)_3$ and $Ge(OR)_4$ (R is a hydrocarbon group or the like) to hydrolysis polycondensation, colloidal inorganic compounds such as $SiO_2$, etc. may be allowed to coexist. As the pillar, an oxide formed by intercalating the above metallic hydroxide ion between layers and then performing thermal dehydration, or the like can be mentioned.

Of the above carriers, preferable are clays and clay minerals, and particularly preferable are montmorillonite, vermiculite, pectolite, taeniolite and synthetic mica.

The organic compound functioning as the carrier (c) may be a granular or fine particulate solid having a particle diameter of 0.5 to 300 μm. Specific examples thereof include (co)polymers produced using, as a main component, an α-olefin having 2 to 14 carbon atoms such as ethylene, propylene, 1-butene and 4-methyl-1-pentene; (co)polymers produced using, as a main component, vinylcyclohexane or styrene; and modified products thereof.

A polymerization method using an olefin polymerization catalyst can afford the ethylene/α-olefin copolymer (C) having high randomness and thus allows the polymerization temperature to be increased. That is, the olefin polymerization catalyst can suppress a decrease in randomness of the ethylene/α-olefin copolymer (C) produced during polymerization at a high temperature. In solution polymerization, a polymerization solution including an ethylene/α-olefin copolymer (C) produced exhibits low viscosity when the temperature is high and thus the concentration of the ethylene/α-olefin copolymer (C) in the polymerizer can be increased as compared to when the polymerization takes place at a lower temperature. As a result, the productivity per polymerizer is enhanced. While the copolymerization of ethylene with α-olefins in the invention may be carried out by any of liquid-phase polymerization processes such as solution polymerization and suspension polymerization (slurry polymerization) and gas-phase polymerization processes, solution polymerization is particularly preferable because the greatest advantage can be taken of the effects of the invention.

The components of the olefin polymerization catalyst may be used in any manner and may be added in any order without limitation. At least two or more of the components for the catalyst may be placed in contact together beforehand.

The bridged metallocene compound (a) (hereinafter, also written as the "component (a)") is usually used in an amount of $10^{-9}$ to $10^{-1}$ mol, and preferably $10^{-8}$ to $10^{-2}$ mol per 1 L of the reaction volume.

The organometallic compound (b-1) (hereinafter, also written as the "component (b-1)") is usually used in such an amount that the molar ratio of the component (b-1) to the transition metal atoms (M) in the component (a) [(b-1)/M] is 0.01 to 50,000, and preferably 0.05 to 10,000.

The organoaluminum oxy compound (b-2) (hereinafter, also written as the "component (b-2)") is usually used in such an amount that the molar ratio of the aluminum atoms in the component (b-2) to the transition metal atoms (M) in the component (a) [(b-2)/M] is 10 to 5,000, and preferably 20 to 2,000.

The ionic compound (b-3) (hereinafter, also written as the "component (b-3)") is usually used in such an amount that the molar ratio of the component (b-3) to the transition metal atoms (M) in the component (a) [(b-3)/M] is 1 to 10,000, and preferably 1 to 5,000.

The polymerization temperature is usually −50° C. to 300° C., preferably 30 to 250° C., more preferably 100° C. to 250° C., and still more preferably 130° C. to 200° C. In this range of polymerization temperatures, the solution viscosity during the polymerization is decreased and the removal of polymerization heat is facilitated with increasing temperature. The polymerization pressure is usually normal pressure to 10 MPa in gauze pressure (MPa-G), and preferably normal pressure to 8 MPa-G.

The polymerization reaction may be performed batchwise, semi-continuously or continuously. The polymerization may be carried out continuously in two or more polymerizers under different reaction conditions.

The molecular weight of the copolymer to be obtained may be controlled by controlling the hydrogen concentration in the polymerization system or the polymerization temperature. Alternatively, the molecular weight may be controlled by controlling the amount of the component (b) used. When hydrogen is added, the appropriate amount thereof is about 0.001 to 5,000 NL per 1 kg of the copolymer produced.

The polymerization solvent used in the liquid-phase polymerization process is usually an inert hydrocarbon solvent, and is preferably a saturated hydrocarbon having a boiling point of 50° C. to 200° C. under normal pressure. Specific examples of the polymerization solvents include aliphatic hydrocarbons such as propane, butane, pentane, hexane, heptane, octane, decane, dodecane and kerosine, and alicyclic hydrocarbons such as cyclopentane, cyclohexane and methylcyclopentane. Particularly preferred solvents are hexane, heptane, octane, decane and cyclohexane. The α-olefins themselves to be polymerized may be used as the polymerization solvents. Although aromatic hydrocarbons such as benzene, toluene and xylene and halogenated hydrocarbons such as ethylene chloride, chlorobenzene and dichloromethane are usable as the polymerization solvents, the use of these solvents is not preferable from the point of view of the reduction of environmental loads and in order to minimize the influence on the human body health.

The kinematic viscosity of ethylene/α-olefin polymers at 100° C. depends on the molecular weight of the copolymers. That is, high-molecular weight polymers exhibit a high viscosity whilst low-molecular weight polymers have a low viscosity. Thus, the kinematic viscosity at 100° C. is adjusted by controlling the molecular weight in the above-described manner. Further, the molecular weight distribution (Mw/Mn) may be controlled by removing low-molecular weight components from the resulting polymer by a known method such as vacuum distillation. Further, the polymer obtained may be hydrogenated by a known method (hereinafter also written as "hydrogenation"). If unsaturated bonds in the obtained polymers are reduced by the hydrogenation, oxidation stability and heat resistance are enhanced.

The obtained ethylene/α-olefin copolymers (C) may be used singly, or two or more differing in molecular weight or having different monomer compositions may be used in combination.

Functional groups in the ethylene/α-olefin copolymer (C) may be graft modified, and such a modified copolymer may be secondarily modified. For example, methods described in literature such as JP-A-S61-126120 and Japanese Patent No. 2593264 may be adopted. An example secondary modification method is described in JP-A-2008-508402.

<Lubricant Oil Compositions for Automotive Gears>

The lubricant oil composition for automotive gears according to the present invention includes the lubricant base oil including the mineral oil (A) and/or the synthetic oil (B), and the ethylene/α-olefin copolymer (C) described hereinabove.

The lubricant oil composition for automotive gears according to the present invention has a kinematic viscosity at 100° C. of 4.0 to 9.0 $mm^2/s$. The kinematic viscosity is a value measured in accordance with the method described in JIS K2283. If the kinematic viscosity at 100° C. of the lubricant oil composition for automotive gears excessively exceeds 9.0 $mm^2/s$, the ability of the lubricant itself to keep the form of an oil film is increased and consequently full advantage cannot be taken of the present invention. Further, such a high viscosity deteriorates the fuel efficiency performance. If the kinematic viscosity at 100° C. is excessively lower than 4.0 $mm^2/s$, the ability to keep the form of an oil film is reduced, and thus the risk of contact between metallic parts in gears increases. The kinematic viscosity at 100° C. is preferably 4.0 to 9.0 $mm^2/s$, and more preferably 4.2 to 6.5 $mm^2/s$. This range can provide high fuel efficiency performance and extremely excellent shear stability.

In the lubricant oil composition for automotive gears according to the present invention, the ratio in which the lubricant base oil including the mineral oil (A) and/or the synthetic oil (B) and the ethylene/α-olefin copolymer (C) are blended is not particularly limited as long as the characteristics required for the target application are satisfied. The lubricant oil composition usually contains the lubricant base oil and the ethylene/α-olefin copolymer (C) in a mass ratio (mass of lubricant base oil/mass of copolymer (C)) is 99/1 to 50/50, preferably 85/15 to 60/40, and more preferably 80/20 to 65/35.

The lubricant oil composition for automotive gears according to the present invention may contain additives such as extreme pressure additives, detergent dispersants, viscosity index improvers, antioxidants, corrosion inhibitors, antiwear agents, friction modifiers, pour-point depressants, antirust agents and antifoaming agents.

Examples of the additives used in the lubricant oil compositions for automotive gears according to the present invention include the following. These additives may be used singly, or two or more may be used in combination.

Extreme pressure additives are compounds that have an effect of preventing seizing when automotive gears are subjected to high load conditions, and are not particularly limited. Examples include sulfur-containing extreme pressure additives such as sulfides, sulfoxides, sulfones, thiophosphinates, thiocarbonates, sulfurized oils and fats, and sulfurized olefins; phosphoric acids such as phosphate esters, phosphite esters, phosphate ester amine salts and phosphite ester amine salts; and halogen compounds such as chlorinated hydrocarbons. Two or more of these compounds may be used in combination.

In some cases, hydrocarbons or other organic components constituting the lubricant oil composition for automotive gears may be carbonized by heat or shear before the extreme pressure lubrication conditions are reached, forming a carbide film on metal surfaces. Thus, the extreme pressure additive used alone may be prevented from sufficient contact with the metal surface due to such a carbide film, and the extreme pressure additive may fail to provide sufficient effects that are expected.

The extreme pressure additive may be added singly. However, in view of the fact that the automotive gear oil in the present invention consists primarily of saturated hydrocarbons such as the copolymer, an advantage in dispersibility may be obtained by adding the extreme pressure additive together with other additives in the dissolved state in a lubricant base oil such as a mineral oil or a synthetic hydrocarbon oil. Specifically, an extreme pressure additive package is more preferably added to the lubricant oil composition. The extreme pressure additive package is obtained by blending components including the extreme pressure additive component in advance and dissolving the blend into a lubricant base oil such as a mineral oil or a synthetic hydrocarbon oil.

Preferred examples of the extreme pressure additives (packages) include Anglamol-98A manufactured by LUBRIZOL, Anglamol-6043 manufactured by LUBRIZOL, HITEC 1532 manufactured by AFTON CHEMICAL, HITEC 307 manufactured by AFTON CHEMICAL, HITEC 3339 manufactured by AFTON CHEMICAL and Additin RC 9410 manufactured by RHEIN CHEMIE.

The extreme pressure additives are used as required in the range of 0 to 10 mass % relative to 100 mass % of the lubricant oil composition for automotive gears.

Examples of detergent dispersants include metal sulfonates, metal phenates, metal phosphanates and succinimide. The detergent dispersants are used as required in the range of 0 to 15 mass % relative to 100 mass % of the lubricant oil composition for automotive gears.

Examples of the antiwear agents include inorganic or organic molybdenum compounds such as molybdenum disulfide, graphite, antimony sulfide and polytetrafluoroethylene. The antiwear agents are used as required in the range of 0 to 3 mass % relative to 100 mass % of the lubricant oil composition for automotive gears.

Examples of the friction modifiers include amine compounds, imide compounds, fatty acid esters, fatty acid amides and fatty acid metal salts having, per molecule, at least one alkyl group or alkenyl group, particularly linear alkyl group or linear alkenyl group, having 6 to 30 carbon atoms.

Examples of the amine compounds include linear or branched, preferably linear aliphatic monoamines, linear or branched, preferably linear aliphatic polyamines, having 6 to 30 carbon atoms, and alkylene oxide adducts of these aliphatic amines. Examples of the imide compounds include imide succinates having linear or branched alkyl groups or alkenyl groups having 6 to 30 carbon atoms, and/or compounds obtained by modification of the imide succinates with carboxylic acid, boric acid, phosphoric acid, sulfuric acid or the like. Examples of the fatty acid esters include esters of a linear or branched, preferably linear fatty acid having 7 to 31 carbon atoms and an aliphatic monohydric alcohol or aliphatic polyhydric alcohol. Examples of the fatty acid amides include amides of linear or branched, preferably linear fatty acid having 7 to 31 carbon atoms and an aliphatic monoamine or aliphatic polyamine. Examples of the fatty acid metal salts include alkaline earth metal salts (magnesium salts, calcium salts and the like) and zinc salts of linear or branched, preferably linear fatty acids having 7 to 31 carbon atoms.

The friction modifiers are used as required in the range of 0 to 5.0 mass % relative to 100 mass % of the lubricant oil composition for automotive gears.

Examples of the antioxidants include phenol compounds such as 2,6-di-t-butyl-4-methylphenol, and amine compounds. The antioxidants are used as required in the range of 0 to 3 mass % relative to 100 mass % of the lubricant oil composition for automotive gears.

Examples of the corrosion inhibitors include compounds such as benzotriazole, benzoimidazole and thiazole. The corrosion inhibitors are used as required in the range of 0 to 3 mass % relative to 100 mass % of the lubricant composition.

Examples of the antirust agents include various amine compounds, metal carboxylate salts, polyhydric alcohol esters, phosphorus compounds and sulfonates. The antirust agents are used as required in the range of 0 to 3 mass % relative to 100 mass % of the lubricant oil composition for automotive gears.

Examples of the antifoaming agents include silicone compounds such as dimethylsiloxane and silica gel dispersions, alcohol compounds and ester compounds. The antifoaming agents are used as required in the range of 0 to 0.2 mass % relative to 100 mass % of the lubricant oil composition for automotive gears.

The pour-point depressants may be any of various known pour-point depressants. Specific examples include polymer compounds having organic acid ester groups. Vinyl polymers having organic acid ester groups are particularly suited. Examples of the vinyl polymers having organic acid ester groups include (co)polymers of alkyl methacrylates, (co)polymers of alkyl acrylates, (co)polymers of alkyl fumarates, (co)polymers of alkyl maleates and alkylated naphthalenes.

The pour-point depressants have a melting point of not more than −13° C., preferably −15° C., and more preferably not more than −17° C. The melting point of the pour-point depressants is measured with a differential scanning calorimeter (DSC). Specifically, approximately 5 mg of the sample is placed into an aluminum pan, heated to 200° C., held at 200° C. for 5 minutes, cooled to −40° C. at 10° C./min, held at −40° C. for 5 minutes, and heated at 10° C./min, and the endothermic curve obtained during the second heating is analyzed to determine the melting point.

The pour-point depressants have a weight average molecular weight in the range of 20,000 to 400,000, preferably 30,000 to 300,000, and more preferably in the range of 40,000 to 200,000 as measured by gel permeation chromatography relative to standard polystyrenes.

The pour-point depressants are used as required in the range of 0 to 2 mass % relative to 100 mass % of the lubricant oil composition for automotive gears.

In addition to the additives described hereinabove, other additives such as demulsifying agents, colorants and oiliness agents (oiliness improvers) may be used as required.

<Uses>

The lubricant oil compositions for automotive gears according to the present invention may be suitably used for automotive gear oils such as differential gear oils or manual transmission oils. The lubricant oil compositions for automotive gears according to the present invention have extremely excellent shear stability and temperature viscosity characteristics, and can significantly improve the fuel efficiency performance of automobiles.

EXAMPLES

The present invention will be described in further detail based on Examples hereinbelow without limiting the scope of the invention to such Examples.

[Evaluation Methods]

In the following description such as Examples and Comparative Examples, properties and characteristics of ethylene/α-olefin copolymers and lubricant oil compositions for automotive gears were measured by the following methods.

<Number of Unsaturated Bonds (Number/1000 C)>

A $^1$H-NMR spectrum was measured in o-dichlorobenzene-$d_4$ as a measurement solvent at a measurement temperature of 120° C., a spectrum width of 20 ppm, a pulse repetition time of 7.0 sec and a pulse width of 6.15 μsec (45° pulse) (400 MHz, ECX400P manufactured by JEOL Ltd.). The peak of the solvent (orthodichlorobenzene, 7.1 ppm) was used as the chemical shift reference. The ratio of the integral of peaks derived from a vinyl, a vinylidene, a disubstituted olefin and a trisubstituted olefin observed at 4 to 6 ppm to the main peak observed at 0 to 3 ppm was calculated to determine the number of double bonds per 1000 carbon atoms (number/1000 C).

<Ethylene Content (Mol %)>

With Fourier transform infrared spectrophotometer FT/IR-610 or FT/IR-6100 manufactured by JASCO Corporation, the absorbance ratio (D1155 $cm^{-1}$/D721 $cm^{-1}$) of the absorption near 1155 $cm^{-1}$ based on the framework vibration of propylene to the absorption near 721 $cm^{-1}$ based on the transverse vibration of long-chain methylene groups was calculated. The ethylene content (wt %) was determined based on a calibration curve prepared beforehand (using standard samples in accordance with ASTM D3900). Next, the ethylene content (mol %) was determined using the following equation based on the ethylene content (wt %) obtained above.

$$\text{Ethylene content (mol \%)} = \frac{[\text{Ethylene content (wt \%)} \div 28]}{[\text{Ethylene content (wt \%)} \div 28] + [\text{Propylene content (wt \%)} \div 42]} \quad \text{[Math. 1]}$$

<Molecular Weight Distribution>

The molecular weight distribution was measured using HLC-8320GPC manufactured by TOSOH CORPORATION in the following manner. TSKgel SuperMultipore HZ-M (four columns) were used as separation columns. The column temperature was 40° C. Tetrahydrofuran (manufactured by Wako Pure Chemical Industries, Ltd.) was used as a mobile phase. The developing speed was 0.35 ml/min. The sample concentration was 5.5 g/L. The sample injection amount was 20 μL. A differential refractometer was used as a detector. Standard polystyrenes manufactured by TOSOH CORPORATION (PStQuick MP-M) were used. In accordance with general calibration procedures, the weight average molecular weight (Mw) and the number average molecular weight (Mn) were calculated with reference to the molecular weight of polystyrene to determine the molecular weight distribution (Mw/Mn).

<Melting Point>

X-DSC-7000 manufactured by Seiko Instruments Inc. was used. Approximately 8 mg of the ethylene/α-olefin copolymer was placed into a readily closable aluminum sample pan, and the pan was arranged in the DSC cell. In a nitrogen atmosphere, the DSC cell was heated from room temperature to 150° C. at 10° C./min and was held at 150° C. for 5 minutes. Thereafter, the DSC cell was cooled to −100° C. at 10° C./min (cooling process). Next, the cell was held at −100° C. for 5 minutes and was heated at 10° C./min. The temperature corresponding to a maximum value in the enthalpy curve recorded during the heating process was defined as a melting point (Tm), and the sum of amounts of heat absorption associated with melting was defined as a heat of fusion (ΔH). The copolymer was regarded as having no melting point (Tm) when there were no peaks or when the heat of fusion (ΔH) was not more than 1 J/g. The determination of the melting point (Tm) and the heat of fusion (ΔH) was based on JIS K7121.

<Viscosity Characteristics>

The kinematic viscosity at 100° C. and the viscosity index were measured and calculated by the method described in JIS K2283.

<Pour Point>

The pour point was measured in accordance with the method described in ASTM D97. Pour points below −60° C. were categorized as being not more than −60° C.

<Shear Test>

The shear stability of the lubricant oil composition for automotive gears was evaluated with a KRL shear tester in accordance with the method described in CRC L-45-T-93. The lubricant oil composition was subjected to shearing under shearing conditions by the shear test at a test temperature of 60° C. and a bearing rotational speed of 1450 rpm for a test time of 100 hours. The rate of viscosity drop by shearing (shear test viscosity drop rate) at 100° C. was evaluated using the following equation.

Rate of viscosity drop by shear test (%)=(Kinematic viscosity at 100° C. before shearing−Kinematic viscosity at 100° C. after shearing)/Kinematic viscosity at 100° C. before shearing×100

<Viscosity at −40° C.>

As low-temperature viscosity characteristics, the viscosity at −40° C. was measured at −40° C. with a Brookfield viscometer in accordance with ASTM D2983.

<Appearance>

The appearance of the composition obtained was visually evaluated.

○: Clear

Δ: Slightly cloudy x: Obviously cloudy

[Production of Ethylene/α-Olefin Copolymers (C)]

Ethylene/α-olefin copolymers (C) were produced in accordance with Polymerization Examples described later. Where necessary, the ethylene/α-olefin copolymers (B) obtained were hydrogenated by the following method.

<Hydrogenation Process>

A 1 L-volume stainless steel autoclave was loaded with 100 mL of a hexane solution of a 0.5 mass % Pd/alumina catalyst and 500 mL of a 30 mass % hexane solution of the ethylene/α-olefin copolymer. After being tightly closed, the autoclave was purged with nitrogen. Next, the temperature was increased to 140° C. while performing stirring and the system was purged with hydrogen. The pressure was raised with hydrogen to 1.5 MPa and the hydrogenation reaction was performed for 15 minutes.

Synthesis of Metallocene Compound

Synthetic Example 1

Synthesis of [methylphenylmethylene($\eta^5$-cyclopentadienyl)($\eta^5$-2,7-di-t-butylfluorenyl)]zirconium dichloride (i) Synthesis of 6-methyl-6-phenylfulvene In a nitrogen atmosphere, a 200 mL three-necked flask was loaded with 7.3 g (101.6 mmol) of lithium cyclopentadiene and 100 mL of dehydrated tetrahydrofuran. The mixture was stirred. The resultant solution was cooled in an ice bath, and 15.0 g (111.8 mmol) of acetophenone was added dropwise. The mixture was stirred at room temperature for 20 hours. The resultant solution was quenched with an aqueous diluted hydrochloric acid solution. 100 mL of hexane was added, and soluble components were extracted. The organic phase was then washed with water and saturated brine and was dried with anhydrous magnesium sulfate. Thereafter, the solvent was distilled off, and the resultant viscous liquid was separated by column chromatography (hexane) to give the target product (a red viscous liquid).

(ii) Synthesis of methyl(cyclopentadienyl)(2,7-di-t-butylfluorenyl)(phenyl)methane In a nitrogen atmosphere, a 100 mL three-necked flask was loaded with 2.01 g (7.20 mmol) of 2,7-di-t-butylfluorene and 50 mL of dehydrated t-butyl methyl ether. While performing cooling in an ice bath, 4.60 mL (7.59 mmol) of a n-butyllithium/hexane solution (1.65 M) was added gradually. The mixture was stirred at room temperature for 16 hours. Further, 1.66 g (9.85 mmol) of 6-methyl-6-phenylfulvene was added, and the mixture was stirred for 1 hour while performing heating under reflux. While performing cooling in an ice bath, 50 mL of water was added gradually. The resultant two-phase solution was transferred to a 200 mL separatory funnel. After 50 mL of diethyl ether had been added, the funnel was shaken several times and the aqueous phase was removed. The organic phase was washed with 50 mL of water three times and with 50 mL of saturated brine one time. The liquid was dried with anhydrous magnesium sulfate for 30 minutes and thereafter the solvent was distilled off under reduced pressure. A small amount of hexane was added, and the solution was ultrasonicated. The resultant solid precipitate was recovered, washed with a small amount of hexane, and dried under reduced pressure to give 2.83 g of methyl(cyclopentadienyl)(2,7-di-t-butylfluorenyl)(phenyl)methane as a white solid.

(iii) Synthesis of [methylphenylmethylene($\eta^5$-cyclopentadienyl)($\eta^5$-2,7-di-t-butylfluorenyl)]zirconium dichloride To a 100 mL Schlenk flask, 1.50 g (3.36 mmol) of methyl(cyclopentadienyl)(2,7-di-t-butylfluorenyl)(phenyl)methane, 50 mL of dehydrated toluene and 570 μL (7.03 mmol) of THF were added sequentially in a nitrogen atmosphere. While performing cooling in an ice bath, 4.20 mL (6.93 mmol) of a n-butyllithium/hexane solution (1.65 M) was added gradually. The mixture was stirred at 45° C. for 5 hours. The solvent was distilled off under reduced pressure, and 40 mL of dehydrated diethyl ether was added. The addition resulted in a red solution. While performing cooling in a methanol/dry ice bath, 728 mg (3.12 mmol) of zirconium tetrachloride was added. Stirring was performed for 16 hours while increasing the temperature gradually to room temperature, resulting in a red orange slurry. The solvent was distilled off under reduced pressure. In a glove box, the resultant solid was washed with hexane and was extracted with dichloromethane. The extract was concentrated by distilling off the solvent under reduced pressure. A small amount of hexane was added to the concentrate, and the mixture was allowed to stand at −20° C. The resultant red orange solid precipitate was washed with a small amount of hexane and was dried under reduced pressure. Consequently, 1.20 g of [methylphenylmethylene($\eta^5$-cyclopentadienyl)($\eta^5$-2,7-di-t-butylfluorenyl)]zirconium dichloride was obtained as a red orange solid.

Synthetic Example 2

Synthesis of [ethylene($\eta^5$-cyclopentadienyl)($\eta^5$-2,7-di-t-butylfluorenyl)]zirconium dichloride The [ethylene($\eta^5$-cyclopentadienyl)($\eta^5$-2,7-di-t-butylfluorenyl)]zirconium dichloride was synthesized in accordance with the method described in Japanese Patent No. 4367687.

Polymerization Example 1

A 2 L-volume stainless steel autoclave that had been thoroughly purged with nitrogen was loaded with 910 mL of heptane and 35 g of propylene. After the temperature of the system had been increased to 130° C., the total pressure was increased to 3 MPaG by supplying hydrogen at 2.33 MPa and ethylene at 0.07 MPa. Next, 0.4 mmol of triisobutylaluminum, 0.0006 mmol of [methylphenylmethylene($\eta^5$-cyclopentadienyl)($\eta^3$-2,7-di-t-butylfluorenyl)]zirconium dichloride and 0.006 mmol of N,N-dimethylanilinium tetrakis(pentafluorophenyl) borate were injected with nitrogen. The mixture was stirred at a rotational speed of 400 rpm. The polymerization was thus initiated. The polymerization was performed at 130° C. for 5 minutes while keeping the total pressure at 3 MPaG by continuously supplying ethylene alone. The polymerization was terminated by the addition of a small amount of ethanol to the system. Unreacted ethylene, propylene and hydrogen were purged. The polymer solution obtained was washed with 1000 mL of 0.2 mol/L hydrochloric acid three times and with 1000 mL of distilled water three times, and was dried with magnesium sulfate. The solvent was distilled off under reduced pressure. The polymer was dried at 80° C. under reduced pressure overnight. With thin-film evaporator model 2-03 manufactured by Shinko Pantec Co., Ltd., thin-film distillation was performed at a preset temperature of 180° C. and a flow rate of 3.1 mL/min while maintaining the degree of vacuum at 400 Pa. Consequently, a transparent and colorless ethylene-propylene copolymer weighing 22.2 g was obtained. Further, the ethylene-propylene copolymer was hydrogenated.

The results of evaluation of the polymer (polymer 1) obtained by the above process are shown in Table 3.

Polymerization Example 2

Except that the loading amount of propylene was 45 g, hydrogen was supplied at 2.26 MPa, and ethylene was supplied at 0.15 MPa, the same procedure as in Polymerization Example 1 was carried out to obtain a transparent and colorless ethylene-propylene copolymer. Further, the ethylene-propylene copolymer was hydrogenated.

The results of evaluation of the polymer (polymer 2) obtained by the above process are shown in Table 3.

Polymerization Example 3

Except that the loading amount of propylene was 45 g, hydrogen was supplied at 2.20 MPa, and ethylene was supplied at 0.12 MPa, the same procedure as in Polymerization Example 1 was carried out to obtain a transparent and colorless ethylene-propylene copolymer. Further, the ethylene-propylene copolymer was hydrogenated.

The results of evaluation of the polymer (polymer 3) obtained by the above process are shown in Table 3.

Polymerization Example 4

Except that the loading amount of propylene was 45 g, hydrogen was supplied at 2.17 MPa, and ethylene was supplied at 0.15 MPa, the same procedure as in Polymerization Example 1 was carried out to obtain a transparent and colorless ethylene-propylene copolymer. Further, the ethylene-propylene copolymer was hydrogenated.

The results of evaluation of the polymer (polymer 4) obtained by the above process are shown in Table 3.

Polymerization Example 5

A 2 L-volume stainless steel autoclave that had been thoroughly purged with nitrogen was loaded with 760 mL of heptane and 50 g of propylene. After the temperature of the system had been increased to 150° C., the total pressure was increased to 3 MPaG by supplying hydrogen at 2.10 MPa and ethylene at 0.12 MPa. Next, 0.4 mmol of triisobutylaluminum, 0.0002 mmol of [methylphenylmethylene($\eta^5$-cyclopentadienyl)($\eta^5$-2,7-di-t-butylfluorenyl)]zirconium dichloride and 0.002 mmol of N,N-dimethylanilinium tetrakis(pentafluorophenyl) borate were injected with nitrogen. The mixture was stirred at a rotational speed of 400 rpm. The polymerization was thus initiated. The polymerization was performed at 150° C. for 5 minutes while keeping the total pressure at 3 MPaG by continuously supplying ethylene. The polymerization was terminated by the addition of a small amount of ethanol to the system. Unreacted ethylene, propylene and hydrogen were purged. The polymer solution obtained was washed with 1000 mL of 0.2 mol/L hydrochloric acid three times and with 1000 mL of distilled water three times, and was dried with magnesium sulfate. The solvent was distilled off under reduced pressure. The polymer was dried at 80° C. under reduced pressure for 10 hours to obtain an ethylene-propylene copolymer. Further, the ethylene-propylene copolymer was hydrogenated.

The results of evaluation of the polymer (polymer 5) obtained by the above process are shown in Table 3.

Polymerization Example 6

Except that the loading amount of propylene was 50 g, hydrogen was supplied at 2.15 MPa, and ethylene was supplied at 0.12 MPa, the same procedure as in Polymerization Example 1 was carried out to obtain a transparent and colorless ethylene-propylene copolymer. Further, the ethylene-propylene copolymer was hydrogenated.

The results of evaluation of the polymer (polymer 6) obtained by the above process are shown in Table 3.

Polymerization Example 7

A 2 L-volume stainless steel autoclave that had been thoroughly purged with nitrogen was loaded with 710 mL of heptane and 95 g of propylene. After the temperature of the system had been increased to 150° C., the total pressure was increased to 3 MPaG by supplying hydrogen at 1.34 MPa and ethylene at 0.32 MPa. Next, 0.4 mmol of triisobutylaluminum, 0.0001 mmol of [methylphenylmethylene($\eta^5$-cyclopentadienyl)($\eta^3$-2,7-di-t-butylfluorenyl)]zirconium dichloride and 0.001 mmol of N,N-dimethylanilinium tetrakis(pentafluorophenyl) borate were injected with nitrogen. The mixture was stirred at a rotational speed of 400 rpm. The polymerization was thus initiated. The polymerization was performed at 150° C. for 5 minutes while keeping the total pressure at 3 MPaG by continuously supplying ethylene alone. The polymerization was terminated by the addition of a small amount of ethanol to the system. Unreacted ethylene, propylene and hydrogen were purged. The polymer solution obtained was washed with 1000 mL of 0.2 mol/L hydrochloric acid three times and with 1000 mL of distilled water three times, and was dried with magnesium sulfate. The solvent was distilled off under reduced pressure. The polymer was dried at 80° C. under reduced pressure overnight. Thus ethylene-propylene copolymer weighing 52.2 g was obtained. Further, the ethylene-propylene copolymer was hydrogenated.

The results of evaluation of the polymer (polymer 7) obtained by the above process are shown in Table 3.

Polymerization Example 8

A 2 L-volume continuous polymerizer equipped with a stirring blade and thoroughly purged with nitrogen was loaded with 1 L of dehydrated and purified hexane. Subsequently, a 96 mmol/L hexane solution of ethylaluminum sesquichloride ($Al(C_2H_5)_{1.5}.Cl_{1.5}$) was continuously fed at a rate of 500 mL/h for 1 hour. Further, there were continuously fed a 16 mmol/L hexane solution of $VO(OC_2H_5)Cl_2$ as a catalyst at a rate of 500 mL/h, and hexane at a rate of 500 mL/h. At the same time, the polymerization liquid was continuously withdrawn from an upper portion of the polymerizer so that the volume of the polymerization liquid in the polymerizer was kept constant at 1 L. Next, 28 L/h ethylene gas, 25 L/h propylene gas and 100 L/h hydrogen gas were supplied through bubbling tubes. The copolymerization reaction was performed at 35° C. while circulating a refrigerant through a jacket fitted to the exterior of the polymerizer.

The polymerization solution which included an ethylene-propylene copolymer obtained under the above conditions was washed with 100 mL of 0.2 mol/L hydrochloric acid three times and with 100 mL of distilled water three times, and was dried with magnesium sulfate. The solvent was distilled off under reduced pressure. The polymer was dried at 130° C. under reduced pressure overnight. The results of evaluation of the above obtained ethylene-propylene copolymer (polymer 8) are shown in Table 3.

TABLE 3

| | | Polymerization Example | | | | | | | |
|---|---|---|---|---|---|---|---|---|---|
| | | Poly-merization Example 1 | Poly-merization Example 2 | Poly-merization Example 3 | Polymerization Example 4 | Polymerization Example 5 | Polymerization Example 6 | Polymerization Example 7 | Polymerization Example 8 |
| Polymer | | Polymer 1 | Polymer 2 | Polymer 3 | Polymer 4 | Polymer 5 | Polymer 6 | Polymer 7 | Polymer 8 |
| Number of unsaturated bonds | number/1000 C | Less than 0.1 | Less than 0.1 | Less than 0.1 | Less than 0.1 | Less than 0.1 | Less than 0.1 | Less than 0.1 | Not measured |
| Ethylene content | mol % | 63.5 | 65.9 | 59.9 | 66.1 | 59.6 | 49.3 | 61.0 | 55.2 |
| Kinematic viscosity at 100° C. | $mm^2/s$ | 46 | 55 | 70 | 80 | 102 | 71 | 1060 | 41 |
| Molecular weight distribution (Mw/Mn) | — | 1.5 | 1.6 | 1.6 | 1.6 | 1.6 | 1.6 | 2.0 | 1.6 |
| Pour point | ° C. | −25 | −22 | −28 | −16 | −27 | −26 | −15 | −15 |
| Melting point | ° C. | −43.0 | −39.0 | −49.0 | −33.0 | −46.0 | Not observed | −38.0 | −51.0 |
| ΔH | J/g | 15.0 | 20.8 | 9.5 | 19.8 | 9.1 | Not observed | 5.8 | 9.9 |
| Visual observation of appearance | — | Transparent and colorless | Transparent and colorless | Transparent and colorless | Transparent and colorless | Transparent and colorless | Transparent and colorless | Transparent and colorless | Heavily cloudy |

[Preparation of Lubricant Oil Compositions for Automotive Gears]

In the preparation of the following lubricant oil compositions for automotive gears, the following components were used in addition to the ethylene/α-olefin copolymers (C).

Lubricant Base oils: API (American Petroleum Institute) Group II mineral oil (NEXBASE 3030 manufactured by Neste, mineral oil-A) having a kinematic viscosity at 100° C. of 3.0 $mm^2/s$, a viscosity index of 106 and a pour point of −30° C.; synthetic oil poly-α-olefin (NEXBASE 2004 manufactured by Neste, synthetic oil-A) having a kinematic viscosity at 100° C. of 4.0 $mm^2/s$, a viscosity index of 123 and a pour point of not more than −60° C.; and fatty acid ester trimethylolpropane C8/C10 ester (manufactured by BASF, synthetic oil-B) having a kinematic viscosity at 100° C. of 4.3 $mm^2/s$ and a viscosity index of 143. Extreme pressure additive package: Anglamol-6043 (EP) manufactured by Lubrizol. Pour-point depressant: IRGAFLO 720P (PPD) manufactured by BASF. PAO: Spectrasyn Elite 65 (mPAO) (manufactured by ExxonMobil Chemical) produced using a metallocene catalyst system, and having a kinematic viscosity at 100° C. of 65 $mm^2/s$ and a viscosity index of 179.

<Lubricant Oil Compositions for Automotive Gears/75 W>

In Examples 1 to 9 and Comparative Examples 1 to 4, the formulations were designed at blending ratios shown in Tables 4-1 and 4-2 to meet SAE Gear Oil Viscosity Grade 75W. The lubricant characteristics of the lubricant oil compositions obtained are collectively shown in Tables 4-1 and 4-2.

TABLE 4-1

| | | Example 1 | Example 2 | Example 3 | Example 4 | Example 5 | Example 6 | Example 7 |
|---|---|---|---|---|---|---|---|---|
| Polymer 1 | mass % | 29.5 | | | | | | 24.1 |
| Polymer 2 | mass % | | 27.2 | | | | | |
| Polymer 3 | mass % | | | 24.0 | | | | |
| Polymer 4 | mass % | | | | 23.0 | | | |
| Polymer 5 | mass % | | | | | 21.3 | | |
| Polymer 6 | mass % | | | | | | | |
| Polymer 7 | mass % | | | | | | | |
| Polymer 8 | mass % | | | | | | 30.0 | |
| mPAO | mass % | | | | | | | |
| Mineral oil-A | mass % | 66.7 | 69.0 | 72.2 | 73.2 | 74.9 | 66.2 | |
| Synthetic oil-A | mass % | | | | | | | 57.4 |
| Synthetic oil-B | mass % | | | | | | | 15.0 |
| EP | mass % | 3.5 | 3.5 | 3.5 | 3.5 | 3.5 | 3.5 | 3.5 |
| PPD | mass % | 0.3 | 0.3 | 0.3 | 0.3 | 0.3 | 0.3 | |
| Kinematic viscosity at 100° C. | $mm^2/s$ | 7.82 | 7.84 | 7.80 | 7.86 | 7.82 | 7.88 | 7.81 |
| Kinematic viscosity at 40° C. | $mm^2/s$ | 40.1 | 40.0 | 39.9 | 40.0 | 39.9 | 40.5 | 40.0 |
| Viscosity index | — | 170 | 171 | 170 | 172 | 171 | 170 | 170 |
| Viscosity at −40° C. | mPa · s | 30,200 | 32,200 | 39,200 | 40,700 | 40,400 | 9,120 | 10,600 |
| Viscosity drop by shear test | % | <0.1 | <0.1 | 0.2 | 0.3 | 0.3 | <0.1 | <0.1 |
| Appearance | | ○ | ○ | ○ | ○ | ○ | Δ | ○ |

TABLE 4-2

| | | Example 8 | Example 9 | Comparative Example 1 | Comparative Example 2 | Comparative Example 3 | Comparative Example 4 |
|---|---|---|---|---|---|---|---|
| Polymer 1 | mass % | | | | | | |
| Polymer 2 | mass % | | | | | | |
| Polymer 3 | mass % | | | | | | |
| Polymer 4 | mass % | 19.0 | | | | | 42.3 |
| Polymer 5 | mass % | | 16.6 | | | | |
| Polymer 6 | mass % | | | 21.5 | | | |
| Polymer 7 | mass % | | | | 10.4 | | |
| Polymer 8 | mass % | | | | | | |
| mPAO | mass % | | | | | 35.8 | |
| Mineral oil-A | mass % | | | 74.7 | 85.8 | 60.4 | 53.9 |
| Synthetic oil-A | mass % | 62.5 | 64.9 | | | | |
| Synthetic oil-B | mass % | 15.0 | 15.0 | | | | |
| EP | mass % | 3.5 | 3.5 | 3.5 | 3.5 | 3.5 | 3.5 |
| PPD | mass % | | | 0.3 | 0.3 | 0.3 | 0.3 |
| Kinematic viscosity at 100° C. | $mm^2/s$ | 7.86 | 7.88 | 7.67 | 8.05 | 7.76 | 14.1 |
| Kinematic viscosity at 40° C. | $mm^2/s$ | 40.1 | 39.9 | 40.3 | 40.1 | 40.0 | 85.1 |
| Viscosity index | — | 171 | 173 | 163 | 179 | 167 | 172 |
| Viscosity at −40° C. | mPa · s | 9,180 | 9,690 | 17,900 | 48,000 | 12,200 | >150,000 |
| Viscosity drop by shear test | % | 0.1 | 0.4 | 0.3 | 3.5 | 1.8 | 0.7 |
| Appearance | | ○ | ○ | ○ | ○ | ○ | ○ |

This viscosity grade is suitably used for such lubricants as automotive differential gear oils, manual transmission oils and dual clutch transmission oils.

The lubricant oil compositions in Examples 1 to 6, which include the mineral oil (A) and the ethylene/α-olefin copolymer (C), and the lubricant oil compositions in Examples 7 to 9, which include the synthetic oil (B) and the ethylene/α-olefin copolymer, can afford low-viscosity lubricants compatible with heavier loads because all these lubricant oil compositions have a viscosity index of not less than 170 and have excellent machine protection performance at high temperature. Further, the lubricant oil compositions for automotive gears have a viscosity at −40° C. of not more than 50,000 mPa·s and a viscosity drop rate by the shear test of less than 0.5%, and thus have excellent shear stability and fluidity at low-temperature. In particular, lubricant oil compositions in which the ethylene/α-olefin copolymer has a kinematic viscosity at 100° C. of not more than 60 $mm^2/s$ as in Examples 1 and 2 have a viscosity drop rate of less than 0.1% after the shear test, and can be particularly suitably used for lubricants for automotive gears which are usable without necessity of replacement. Examples of these lubricants for automotive gears include differential gear oils for ordinary automobiles.

Comparison between Examples and Comparative Example 1 using the polymer 6 having an ethylene content of less than 55 mol % shows that the lubricant oil compositions according to the present invention have a particularly excellent viscosity index, i.e. excellent fuel efficiency indicating how the stirring resistance of lubricants to machines can be reduced. Further, comparison between Comparative Example 2 and Examples shows that the ethylene/α-olefin copolymer having a kinematic viscosity at 100° C. of not more than 200 $mm^2/s$ results in outstandingly excellent shear stability.

Further, comparison between Example 2 or Example 3 and Comparative Example 3 shows that the lubricant oil compositions for automotive gears according to the present invention have excellent temperature viscosity characteristics and shear stability with respect to PAO produced using a metallocene catalyst considered to have excellent temperature viscosity characteristics and low-temperature viscosity characteristics.

In addition, comparison between Examples and Comparative Example 4 shows that the lubricant oil compositions for automotive gears having a kinematic viscosity at 100° C. of not more than 9.0 $mm^2/s$ results in outstandingly excellent shear stability and fluidity at low-temperature.

The invention claimed is:

1. A lubricant oil composition for automotive gears, comprising: a lubricant base oil comprising a mineral oil (A) having characteristics (A1) to (A3) described below, and/or a synthetic oil (B) having characteristics (B1) to (B3) described below; and an ethylene/α-olefin copolymer (C) having characteristics (C1) to (C5) described below, the lubricant oil composition having a kinematic viscosity at 100° C. of 4.0 to 9.0 $mm^2/s$, (A1) the kinematic viscosity at 100° C. is 2.0 to 6.5 $mm^2/s$, (A2) the viscosity index is not less than 105, (A3) the pour point is not more than −10° C., (B1) the kinematic viscosity at 100° C. is 1.0 to 6.5 $mm^2/s$, (B2) the viscosity index is not less than 120, (B3) the pour point is not more than −30° C., (C1) the ethylene content is in the range of 55 to 85 mol %, (C2) the kinematic viscosity at 100° C. is 10 to 200 $mm^2/s$, (C3) the molecular weight distribution (Mw/Mn) for the molecular weight measured by gel permeation chromatography (GPC) with reference to polystyrene is not more than 2.2, (C4) the pour point is not more than −10° C., (C5) the melting point has a peak in the range of −30° C. to −60° C. and gives a heat of fusion (ΔH) of not less than 9.1 J/g and not more than 25 J/g as measured by differential scanning calorimetry (DSC).

2. The lubricant oil composition for automotive gears according to claim 1, wherein the kinematic viscosity of the ethylene/α-olefin copolymer (C) at 100° C. is 20 to 170 $mm^2/s$.

3. The lubricant oil composition for automotive gears according to claim 1, wherein the kinematic viscosity of the ethylene/α-olefin copolymer (C) at 100° C. is 30 to 60 $mm^2/s$.

4. The lubricant oil composition for automotive gears according to claim 1, wherein the content of ethylene in the ethylene/α-olefin copolymer (C) is in the range of 58 to 70 mol %.

5. The lubricant oil composition for automotive gears according to claim 1, wherein the α-olefin in the ethylene/α-olefin copolymer (C) is propylene.

* * * * *